US008172079B2

(12) United States Patent
Greenberg et al.

(10) Patent No.: US 8,172,079 B2
(45) Date of Patent: May 8, 2012

(54) CONTAINER WITH SECONDARY SUBSTANCE, PREFERABLY A LIQUID FOR ATTACHMENT TO AND MIXING WITH CONTAINER OF A PRIMARY LIQUID

(75) Inventors: Russell Jon Greenberg, New York, NY (US); Christopher Eden Marchent Beardsley, New York, NY (US)

(73) Assignee: Wix Industries, LLC, New York, NY (US)

( * ) Notice: Subject to any disclaimer, the term of this patent is extended or adjusted under 35 U.S.C. 154(b) by 838 days.

(21) Appl. No.: 12/070,461

(22) Filed: Feb. 19, 2008

(65) Prior Publication Data

US 2009/0288965 A1 Nov. 26, 2009

Related U.S. Application Data

(60) Provisional application No. 60/902,656, filed on Feb. 21, 2007.

(51) Int. Cl.
*B65D 25/08* (2006.01)

(52) U.S. Cl. ..... 206/222; 206/219

(58) Field of Classification Search ..... 206/219–222, 206/568; 215/6, 10, DIG. 8
See application file for complete search history.

(56) References Cited

U.S. PATENT DOCUMENTS

| | | | | | |
|---|---|---|---|---|---|
| 4,103,772 | A * | 8/1978 | Wiegner | ..... | 206/222 |
| 4,221,291 | A * | 9/1980 | Hunt | ..... | 206/222 |
| 4,693,366 | A * | 9/1987 | Goncalves | ..... | 206/222 |
| 4,989,729 | A * | 2/1991 | Huang | ..... | 206/222 |
| 5,071,034 | A * | 12/1991 | Corbiere | ..... | 206/222 |
| 5,255,812 | A * | 10/1993 | Hsu | ..... | 206/222 |
| 6,092,648 | A * | 7/2000 | Sellars | ..... | 206/221 |
| 6,705,491 | B1 * | 3/2004 | Lizerbram et al. | ..... | 206/221 |
| 6,769,539 | B2 * | 8/2004 | Stern et al. | ..... | 206/222 |

* cited by examiner

*Primary Examiner* — Luan K Bui
(74) *Attorney, Agent, or Firm* — Pryor Cashman LLP; Andrew S. Langsam, Esq.

(57) ABSTRACT

An apparatus for adding a secondary substance to a primary liquid within a sealed container, for example, a shot of liquor to be added to a can of soda. A secondary container contains the secondary substance preferably a liquid and has a frangible seal. A mechanism sealingly and mechanically attaches the secondary container to the hull of a primary container having primary liquid. A frangible seal is provided to the secondary container. A penetrator is disposed at least partially within the housing of the secondary container and is at least partially surrounded by the attachment mechanism. —The penetrator causes rupture of the seal and mechanically penetrates through the hull of the primary container. The substance from the secondary container mixes with the liquid of the primary container. The secondary container may attach to the top, side, or bottom of a conventional primary container, a soda can.

33 Claims, 13 Drawing Sheets

CONTAINER WITH SECONDARY SUBSTANCE, PREFERABLY A LIQUID FOR ATTACHMENT TO AND MIXING WITH CONTAINER OF A PRIMARY LIQUID

RELATED APPLICATIONS

This is a non-provisional patent application claiming priority on prior filed U.S. provisional application Ser. No. 60/902,656 filed Feb. 21, 2007. All description, drawings, and teachings set forth therein are expressly incorporated by reference herein.

BACKGROUND OF THE INVENTION

1. Field of the Invention

The invention relates to a sealed, container-like device for selective, mechanical coupling and securing to a primary container (preferably a conventionally-shaped soda or beer can with a pull tab opening or a pop-top tab) holding a primary liquid for the purpose of mixing pre-measured amounts of a secondary substance or liquid (or other compositions of matter) with the liquid contents of the primary container so that a mixed drink or liquid can be dispensed from the integrated containers. In the preferred embodiment, the inventive device (referred to as the secondary container) might, in one possible use, be sold to consumers and contain a flavored alcoholic drink mix (Mojito Madness, for example) or a non-alcoholic drink mix, a syrup or other flavoring, etc. that would then be mechanically coupled or secured to a separately sold conventional aluminum beer or soda type can (the primary container) holding seltzer, soda, beer, water, or another alcoholic or non-alcoholic liquid (orange juice, for example). Preferably the conventional primary container is provided with a pull tab or pop top tab (collectively referred to hereinafter, for simplicity and convenience, as a "pop top tab") as the opening mechanism. The combined primary and secondary containers, with their respective liquid and substances/mixture/liquid, when mixed, result in a mixed beverage or drink. So, for example, an on the spot made screwdriver can be made formed of the combination of vodka and orange juice; chocolate milk formed of chocolate syrup and milk; rum and coke from their respective components, etc. The present invention can also be used with a different yet conventionally available juice or carbonated beverage container, like a juice box. In use, the user would mechanically attach the new sealed container (the secondary container) with the flavoring liquid or mix to the conventional beverage container (the primary container). When desired for consumption, the user would initiate the mixing of the mixer liquid, the so-called secondary liquid, with the primary liquid in the conventional can, by mechanically piercing the hull of the primary can or container by a mechanism housed or secured within or a component of the secondary container. The fluid contents (e.g., vodka, Mojito Madness Mix, chocolate syrup, etc.), i.e., the secondary substance or mix/liquid of the secondary container-would then be in fluid communication and mix with the liquid contents (the orange juice, seltzer, cola, milk, etc.) of the primary container. The mixed contents could then be consumed by the user/consumer (as a screwdriver, rum and cola, chocolate-flavored milk, etc.). In this manner, mixing pre-measured amounts of a secondary substance (for the substance could be flavoring flakes, for example) or liquid with a primary liquid within a primary container is provided to ensure a perfectly proportioned and readily available mix of the contents of both containers. The availability and ability to dispense the new mixed liquid from the mechanically joined and fluid sealed containers (except for the dispensing orifice), even in remote or 'field' conditions where a third container or any form of measuring cup or device is unavailable is provided. An instant mixed drink is provided. The secondary container or device could be sold for use at outdoor events, tailgate parties, beach parties, sporting events, airport lounges, etc. where the mixing and consumption of a new mixture is desired, formed from a first or soft drink in a conventional, sealed first or primary container, an aluminum pop top tab can, and another mixture or substance, preferably a liquid, a flavoring, alcohol-based mix, etc., initially housed in a sealed secondary container.

2. Description of Related Art

In many instances of using commercially packaged liquids ("primary liquids"), such as beverages, shampoos, massage oils, hair dye compositions, etc., it is common to add a secondary substance or liquid or powder in a relatively small but measured quantity to the primary liquid for the purposes of adding color, flavor, alcohol, dye, fixer, scent, or a host of other reasons. In the case of mixed consumable drinks, for example, it is common to add an ounce or so of an alcoholic-based liquor to five to eight ounces of primary beverage (for example rum into cola). Conventionally, a third container is required to mix or combine the two components into a drinkable solution/beverage. For example, in the case of a rum and cola desired mixed drink, cola is first poured into a glass or tumbler from a cola container, then the rum is often but not always measured and then added from a bottle of rum. The new mixture is then transferred into a new glass or the mixture is made by pouring each into a clean drinking glass and then a mechanically mixing of the liquids occurs. However, it is difficult to prepare such mixed drinks in "field" conditions such as at the beach, in a bus, on a plane, while tailgating in a parking lot prior to a sporting event, etc. Precise measuring is difficult in certain conditions. Elimination of the third container is also often desirable. Thus, it is desired to provide a pre-measured amount of a secondary mixture or substance, preferably a liquid to be added to a pre-measured amount of the primary liquid without the need for a third or separate glass or container for the end mixed drink product. The present invention accomplishes the desired goals.

Even when third containers such as glasses or mugs are available, problems arise after the party is finished—if the glasses are disposable, a tremendous amount of waste and garbage is produced; if the glasses are not disposable, the ensuing washing of the glasses can be a formidable, unpleasant task. Another problem alluded to above arises with mixing drinks, in that novice bartenders may not know how much alcohol to add to a drink and even experienced bartenders may not be precise in their mixing of liquids. Adding either too much or too little liquor or mixer (the secondary liquid) yields an undesirable drink (too soft-drink like or too strong) and can result in the imbalanced drink being tossed away or not enjoyed to its fullest. Using pre-measured amounts of secondary substance, preferably the liquid, especially where the liquid is liquor is desirable since the liquor is generally more expensive than the primary liquid. This can become significant where the host is called upon to provide drinks for a large number of people.

Mixing drinks by adding two liquids in the "field" can also be messy, even in stable conditions. However, the problem is increased in a moving vehicle, for example, in an airplane, on a boat, in a car or bus, etc. Thus, having initially sealed containers for the primary liquid and the secondary substance or mixture material (hereinafter, for convenience and simplicity of reading collectively referred to as the secondary liquid) prior to use, and then using a mechanical and fluid-tight seal between the containers of the individual liquids results in a substantially messless manner of mixing and dispensing mixed drinks, in pre-measured amounts. Similar issues arise in connection with children's beverages, particularly making chocolate milk from a conventional milk bottle or carton and a bottle (typically plastic) or glass jar of chocolate flavored syrup or sauce. Conventionally, flavored syrups are poured, squeezed, or spooned from a bottle into a glass of poured milk or similar beverage and then stirred with a spoon. These actions are simple enough at home, however are pretty close to impossible in a moving car, on a power boat, on a bus, at a museum, or anywhere else one might take children. Even at home, one runs the risk of arguing with a petulant child who firmly believes that insufficient flavoring has been added to her beverage, regardless of how much has actually been added. Thus, it would be beneficial to be able not only to make flavored children's beverages whether or not away from home, without the mess, but do so in a controlled pre-measured manner with a fixed quantity of flavoring for a given quantity of milk (primary beverage or liquid). Providing the mixed drink, whether cola and alcohol, milk and chocolate sauce, energy drinks, vitamin supplements in primary liquids, etc. or any other combination, by adding the secondary liquid to a conventional beer or soda can container holding the primary liquid is highly desired, especially if one could do so in a controlled and messless manner.

When the present invention is used and the secondary container joined to the primary container, the two containers are mechanically integrated and mixing of the substance of the secondary container, preferably a liquid, can be accomplished without mess or fluid leakage or spillage. When the primary container is a conventional soda or beer can with a pop top tab opening, the secondary container can resemble a smaller such container and it can easily snap onto the top, bottom or side of the primary container.

Several previous attempts to solve the above and other problems in this field seem to have fallen short. For example, U.S. Pat. No. 2,631,521 to Atkins describes a beverage mixing container attachable to an initially sealed glass container or bottle. The attachment may be affixed to either a bottle on which the cap has been removed or may be affixed to a bottle with the cap still disposed on and over the mouth of the bottle. The Atkins device would fail to work with modern beverage containers such as aluminum cans or paperboard beverage boxes (e.g., "juice boxes"). Additionally, in order to access (drink) the newly mixed combined beverage, one must first remove the Atkins device from the bottle to gain access to the mouth or opening of the bottle. However, since the bottle is now filled with both its original contents and the liquid contents of the attachment, removal of the attachment may cause spilling and concomitant mess. In any event, the removal of the secondary container from the bottle to allow for drinking of the combined liquid is an extra mechanical step, something desirably avoided.

U.S. Pat. No. 5,255,812 to Hsu describes a self-heating food container, such as a tin can, having a food chamber, a first chemical holding chamber, and a second, separate chemical holding chamber. The first chemical holding chamber is in thermal communication with the food chamber. The second chemical holding chamber includes a chemical which, when mixed with the chemical in the first chemical holding chamber, causes an exothermic reaction which by conduction and convection heats the food contents of the food chamber. This device is not attachable to a conventional beverage container, nor does it physically mix its heat-generating contents with the food or beverage contained in the food chamber.

Other devices, such as that described in U.S. Pat. No. 5,170,888 to Goncalves, are also not attachable to conventional modern beverage containers and are complicated and difficult to manufacture.

The present invention is believed to differ from the prior art, either when that art is individually considered or even if combined together, in that the present invention provides a secondary container of a substance, preferably a liquid, which mechanically and sealingly attaches to the top, side or bottom of a preferable conventional soda or beer can with pull top tab which allows for the consumption of the mixed drink through the top of the can, without the need to remove the secondary container. The consumption can take place through a new pull top tab of the secondary container or through the original pull top tab of the primary container. The present invention contemplates, unlike the prior art, the piercing of the primary container, the conventional soda or beer can with pop top tab either at the pull top tab, through a side wall or through the bottom of the primary container. If through the pop top tab location in the top of the can, the piercing via a penetrator mechanism can either be through the thin-walled hull of the primary container or the piercing mechanism can cause the original pop top tab to open the can by pushing on the same which will cause an opening at the scored weakness point of the conventional pop top tab opening. These and other aspects of the present invention, more fully described hereinafter, serve to distinguish the present invention from the prior art teachings.

The present invention, in the preferred embodiment contemplates that the secondary be attached to the side of the primary container, a soda or beer can with a pop top tab. Here, the liquids of the two containers, after rupturing of the seal of the secondary container and the piercing of the hull of the primary container (irrespective of the order of those steps) will form, in effect, a single mixing chamber with the liquids flowing freely into one another. The free flow of the respective liquids between secondary and primary containers is also accomplished by the bottom loaded embodiment and is believed distinct from the prior art systems of mixing liquids of separate containers where the mixing is in a specified direction, namely, from top-located secondary container to bottom, relatively-located primary container, by gravity dropping the liquid contents of the secondary container to the primary container.

SUMMARY OF THE INVENTION

The invention is an apparatus, preferably a sealed container for a secondary substance, preferably a liquid. When mechanically attached to a primary container, also initially sealed, with a primary liquid contained therein, the new combination is ready for instant mixing and consumption or use. When and where desired, the two components are mechanically coupled. The coupling is also done in a leak proof manner so that when the contents of the two containers are mixed, little if any liquid is allowed to accidentally spill or leak out of the combined containers. When desired, the mixing of the secondary substance, preferably a liquid within a sealed secondary container, occurs with the primary liquid of the primary container. This is accomplished by a piercing or penetrator mechanism provided by the secondary container. This causes an opening of the secondary container (preferably by breaking a frangible seal) and the piercing of the hull of the primary container. The breaking of the seal of the secondary container can occur before, simultaneous with, and even after, the piercing of the primary container.

In one of the disclosed embodiments the frangible seal of the secondary container may break after the hull of the primary container is pierced. However, in most of the disclosed embodiments, the frangible seal on the secondary container is ruptured before the hull of the primary container is pierced. In that one disclosed embodiment of the present invention, the hull of the primary container is first pierced and then, by selecting dimensions and specifications of the secondary container and the elasticity of its frangible seal, the seal is broken only after the piercing of the primary container's hull has first taken place.

In several embodiments of the present invention, the secondary substance or liquid is forcibly injected into the primary container to facilitate mixing. The secondary container may be provided with flexible walls, like a bellows, which not only allows for the mechanical movement of the piercing/penetrating mechanism (from a proximal to a distal position to break the frangible seal of the secondary container and pierce the hull of the primary container) but also allows for a conservation of volume and equalization of pressure between the two chambers. If, for example, one were to combine two containers of rum and carbonated cola, the released pressure of the primary container, the cola soda can would initially cause it to rush into the secondary container with the rum. The flexible walls, however, of the secondary container of the present invention, allow for the increase of volume into the secondary container. In addition, the flexure of the bellows-like walls of the secondary container allows the user to press and squeeze the secondary container to thereby forcibly inject the secondary substance or liquid into the primary container or re-inject the small amount of primary liquid that has entered into the secondary container upon piercing and pressure equalization and the secondary liquid into the primary container for enhanced mixing. The squeezing of the flexible wall of the secondary container back and forth will stir up the liquids and enhance mixing. This can be done before the pop top tab is opened and before drinking.

The new mixture of liquids is then able to be consumed by either drinking the same through the conventional opening formed by removal of the pop top tab of the primary container, through a new pierced opening in the primary container, through a new opening in the secondary container, or by pouring the new mixture into another container. The device comprises a secondary container or housing (only to distinguish it from the primary, sealed, conventional container or housing of the primary liquid, generally in the form of an aluminum tin can with a pop top tab and thin-wall hull) containing a secondary liquid to be added to the primary liquid. A frangible seal keeps the secondary liquid within its housing or chamber until mixing is desired. A mechanical attachment mechanism sealingly i.e., without the probability of liquid mess, attaches the secondary container or housing to the hull of the sealed, conventional primary container. Preferably, this is done in an orientation that places the frangible seal of the secondary container proximal and in opposition to the hull of the sealed, primary and conventional container.

A penetrator mechanism is also provided, disposed at least partially within the housing of the secondary container, but surely associated with the secondary container and at least partially is surrounded by the attachment and sealing mechanism. Thus, when the penetrator is actuated, a liquid seal ensures liquid mixing yet without mess. The attachment of the secondary container to the hull of the primary container keeps the two containers mechanically together and the liquids will be mixed without liquid loss and in a relative messless manner. The penetrator mechanism is adapted to selectively, i.e., when the user desires to accomplish the mixing of the liquids, penetrate through the hull of the primary, sealed container. Penetrating the hull of the sealed container by the penetrator mechanism also breaks the frangible seal of the secondary container (before, simultaneously with or after) and thereby allows the secondary liquid to fluidly mix with the primary liquid of the primary container. The liquid from the secondary container is thus placed into solution with the liquid of the primary container. Thereafter, the mixed drink can be consumed.

The penetrator mechanism may be reciprocatable, movable from a first, proximal position behind the frangible seal to a second, distal position extending past the frangible seal (and breaking it) and then poking or piercing through the hull of the sealed, primary container. In some of the disclosed embodiments the penetrator allows the liquids to mix and then merely opens up the conventional pop top tab of the can by pressing down on the tab and forcing it to open along its weakened lines of scoring.

With the contents of the two containers mixed, the new beverage concoction can be consumed, either through the conventional pop top tab of the primary, conventional container or through a new opening provided by and unsealed when desired in the secondary container.

In the preferred embodiments, the sealed primary container is a conventional beverage, beer-or soda containing can with a pop top tab as the opening mechanism. In one embodiment, the attachment mechanism for the secondary container includes a circular flange which sealingly secures the secondary container to the upper rim of the conventional top of the beer-or soda can of aluminum, resulting in a top-mounted secondary container. In another embodiment, the attachment mechanism comprises a watertight sealing ring or similar seal having adhesive applied thereon, adapted to secure the secondary container to the top, bottom, or a side wall of the beer or soda-containing, aluminum can. In yet another embodiment, the attachment mechanism comprises a flange mechanically and sealingly attachable to the bottom of the conventional can. In the embodiments where the secondary container is securable to the side or bottom of the conventional aluminum, pop top tab can, thereby maintaining access to the top of the can through the pop top tab, the tab and the opening formed by removal of the tab is the point of egress for the mixed liquids. In the embodiment of the invention where the secondary container is secured to the top of the conventional beer-or soda-containing aluminum can, the secondary container may have its own pop top tab. In this embodiment, the secondary container may include a penetrator which pierces or depresses the pop top tab of the primary container (the conventional soda can) for use of that opening for mixing of the solutions and, yet, the secondary container may provide a new opening (which may be resealable) for consumption and pouring of the now-mixed liquids.

According to one aspect of the invention, the secondary container is secured to the primary container by use of a sticky seal material, i.e., a slightly compressive adhesive substance which ensures mechanical coupling by the stickiness of the material and, in addition, water tightness by the compressibility of the material. In the embodiment of the invention where the secondary container is connected to the side wall of the primary container, the sticky seal or mechanical and fluid-tight coupling may be important. Preferably it is in the shape of an "O." This O-seal or coupling will surround the tip of the penetrator when the secondary container is "activated" by pressing the activator mechanism to pierce the wall of the primary container, i.e., when the substance of the secondary container is desirably mixed into the liquid of the primary container. The use of the O-shaped sticky seal, particularly on the side-mounted embodiment of the present invention, also contains the propagation of any rupture in the hull of the primary container (preferably a conventional aluminum beer or soda can). The sticky seal composition or the O-shaped ring (of combined adhesive and fluid tight material) reinforces the primary container's side wall at the point of application and minimizes the spread of the rupture, i.e., the sticky seal contains the rupture of the side wall of the primary container within the boundary of the sticky seal such that it doesn't extend far beyond since the sticky seal will absorb some of the force of the penetration by the penetrator mechanism. Thus, the sticky seal, surrounding the site of the piercing by the penetrator mechanism into the primary container, will, by localizing the rupture and blocking or minimizing its spread beyond the perimeter of the sticky seal, substantially, ensure fluid tightness, i.e., the substantial leakproof transfer of substance from the secondary container to the primary container.

Preferably, at least a portion of the housing of the secondary container is collapsible and flexible, under mechanical pressure. Applying mechanical pressure to that housing causes the penetrator mechanism to penetrate the hull of the sealed, conventional primary container. This allows the liquids of the two containers (primary and secondary) to mix. A first, proximal end of the penetrator may be attached to the housing of the secondary container, so that applying pressure to the flexible housing causes a second, distal end of the penetrator mechanism to penetrate the hull of the sealed primary container. The flexible portion of the housing may include at least one bellowed section. When the penetrator mechanism pierces the hull of the primary container, the liquid of the secondary container, pushed by the pressure on the collapsible secondary container will mix with the liquid of the primary container to produce a new mixed beverage.

As mentioned above, however, the bellows-like secondary container of this embodiment also allows for the pressure and volume of the primary container to flow into the expandable bellows of the secondary container for mixing of the liquids. The flexible bellows also allows the user to forcibly inject the contents of the secondary container into the primary container for thorough mixing. Repeated pressure on the secondary container will force its contents into the primary container and the fluid overflow of the primary container can then be taken up by the expandable bellows of the secondary container for re-injection of the contents back to the primary container. This ensures thorough mixing. Then, after mixing, the pop top tab of the primary container can be opened for consumption of the new mixed drink.

In one embodiment, the housing of the secondary container includes a first compartment in which the secondary liquid is held behind the frangible seal, and at least one second, initially empty compartment. When the frangible seal is broken, the fluid of the second container can mix with the fluid of the first container in the second compartment. Provision of that second compartment facilitates the mixing of the liquids since it provides a void volume to allow for the mixing of the primary liquid and the secondary liquid.

An opening may optionally be provided in the housing of the secondary container, initially closed by a removable seal. After the secondary liquid is allowed to mix with the primary liquid of the respective containers, the seal of this opening is selectively removed and the liquid mixture may be consumed or poured/removed from the opening of the now-integrated containers.

In all embodiments of the invention, the chamber of the secondary device can store flavor crystals or powder or flakes, flavored liquids, water, dietary supplements, flavored syrups, vitamin supplements, alcohol, ice and/or any other potable chemicals, flakes, crystals, substances or liquids which are to be combined with the contents of a conventional, beverage can (preferably a conventional pop top tab, aluminum can) of soda, beer, water, or the like, or another container or bottle of a primary liquid. Different embodiments of the invention attach to the beverage can/bottle/primary container in different ways. Integral to all embodiments of the invention is a mechanical and leakproof connection that is capable of connecting the secondary container to an existing and conventional primary container, whether of a can or bottle, in a manner such that when the liquids of the respective containers are combined, minimal or no fluid leakage outside of mixing within the containers or provided compartments, will occur and, yet, the mixed drink can be consumed when and where desired through an opening.

The vast majority of cans and bottles come in standardized shapes and sizes, which enables the invention to connect with a host of different conventional beverage containers, thereby not requiring, for successful marketing and commercialization of the present invention, any substantial retooling and/or redesign of those containers of primary liquid.

At the point of connection between the invention, the secondary container, and the primary container, preferably the existing conventional bottle/cans of thin-walled aluminum with a pop top tab, a substantially watertight seal is formed. In some embodiments this may be achieved by a tight friction fit, by a rubber gasket or O-ring, and/or by adhesive seals or sticky seals that bind the invention to the host can/bottle without fluid leakage.

In some of the embodiments, a delivery tube or spike-like device punctures the host (primary) can/bottle in order to pierce the hull of the primary container and allow for the transfer of the contents of the secondary container into and to mix with the contents of the primary container. This delivery tube or spike may puncture the top, side-wall, bottom, or merely depress and push open the pop top tab of the primary, conventional container/aluminum can to thereby open the same and to allow for selective consumption of the new mixture.

DETAILED DESCRIPTION OF THE INVENTION AND DRAWINGS

Figure 1:
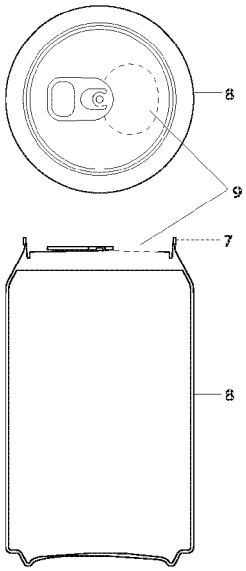
FIG. 1 is a side, cross-sectional and top view of a conventional aluminum can, the so-called primary container, with conventional shape, pop top tab, and base and top.
Figure 2:
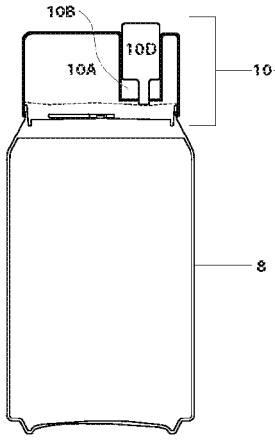
FIG. 2 is a sectional view of a first embodiment of the invention, a secondary liquid container, attached to an aluminum can as shown in FIG. 1.
Figure 2A:
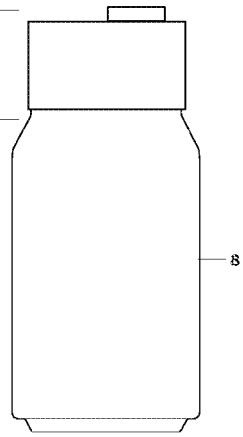
FIG. 2A is perspective and elevational view of the first embodiment of the invention, similar to that shown in FIG. 2, showing the secondary container attached to the top of a conventional aluminum can of the type shown in FIG. 1.
Figure 3:
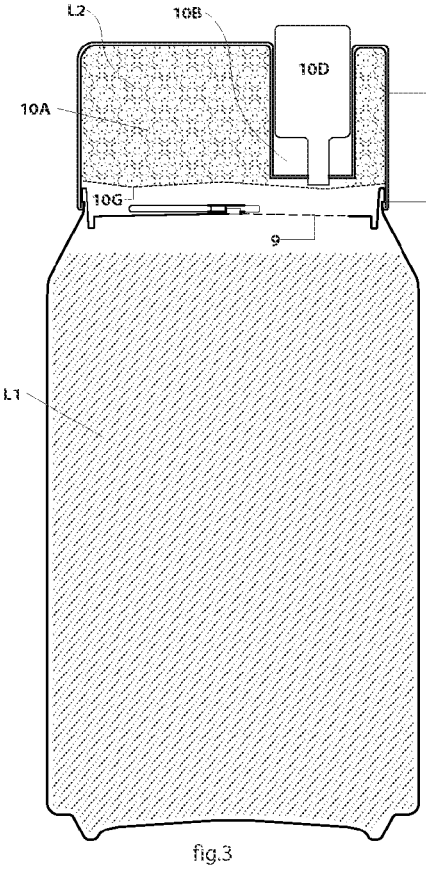
FIG. 3 is an enlarged, cross-sectional view of the embodiment of FIG. 2, showing the attached secondary container with a secondary liquid, to a conventional aluminum can (the primary container) with pop top tab, as shown in FIG. 1 and containing a primary liquid, before the penetrator of the secondary container is actuated to first pierce the frangible seal of the secondary container and then puncture the hull of the primary container or aluminum can.
Figure 4:
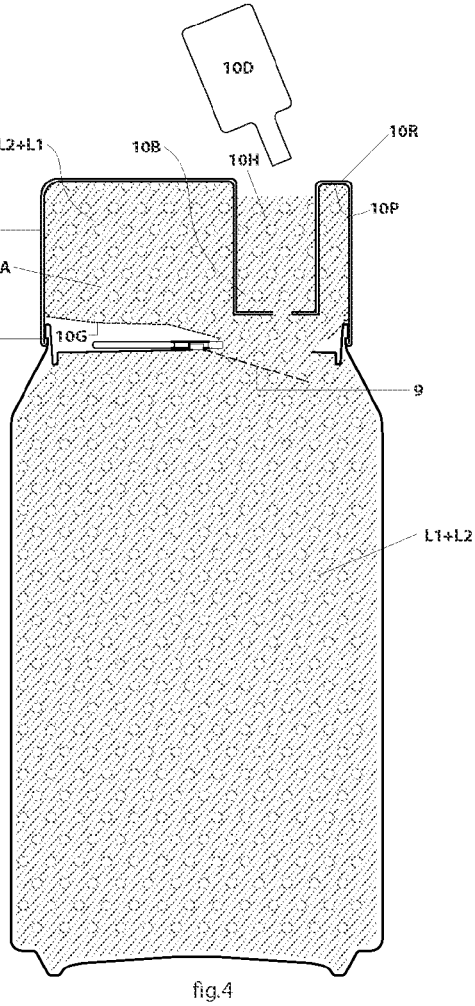
FIG. 4 is a cross-sectional view of the embodiment of the invention shown in FIGS. 2, 2A and 3, showing the secondary container attached to a primary container, an aluminum, pop top tab can, with the liquids of the respective containers mixing, after the frangible seal of the secondary container is pierced by the mechanical penetrator and the pop top tab opened by continued depression of the penetrator, and also showing the penetrator after it has been removed to allow access to the opening of the integrated containers.
Figure 5:
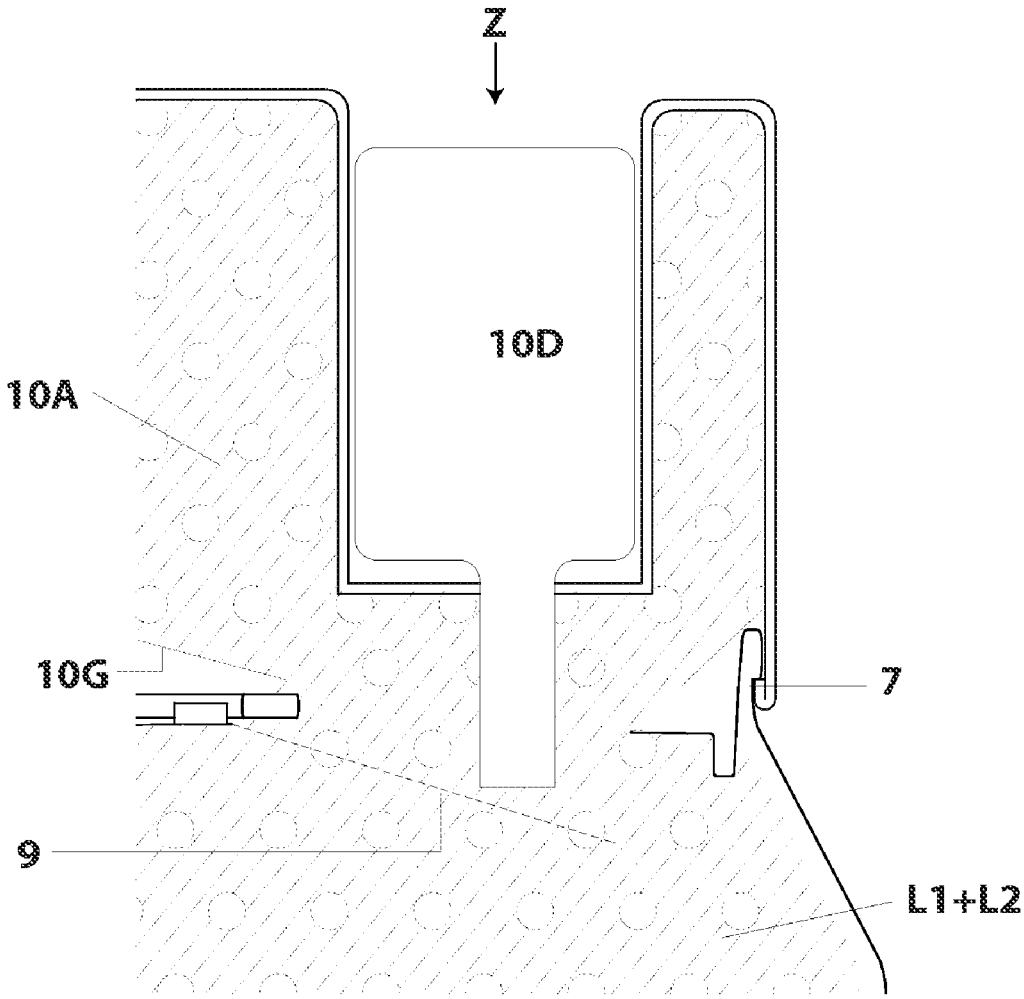
FIG. 5 is an enlarged partial detail of the penetrator of the embodiment of FIGS. 2-4, shown as it is puncturing the frangible seal of the secondary container as pushing on the pop top tab of the aluminum can, the primary container.
Figure 6:
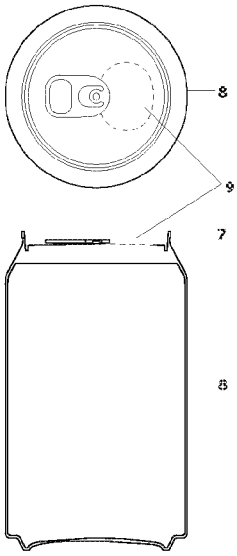
FIG. 6 is a side, cross-sectional and top view of a conventional aluminum can, the so-called primary container, with conventional shape, pop top tab, and base and top substantially as shown in FIG. 1 but repeated here for illustration of another embodiment of the invention, the secondary container as set forth in FIGS. 7 through 10.
Figure 7:
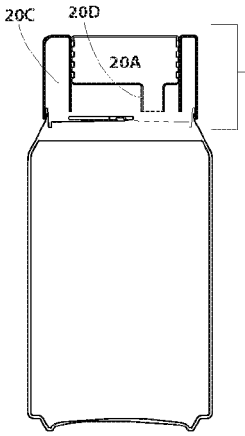
FIG. 7 is a cross sectional view of a second embodiment of the invention, a secondary liquid container, attached to an aluminum can, the primary container, as shown in FIG. 6.
Figure 8:
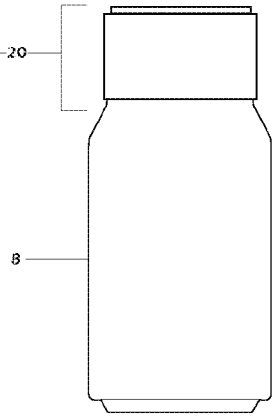
FIG. 8 is perspective and elevational view of the secondary embodiment of the invention, similar to that shown in FIG. 7, showing the secondary container attached to the top of a conventional aluminum can of the type shown in FIG. 6.
Figure 9:
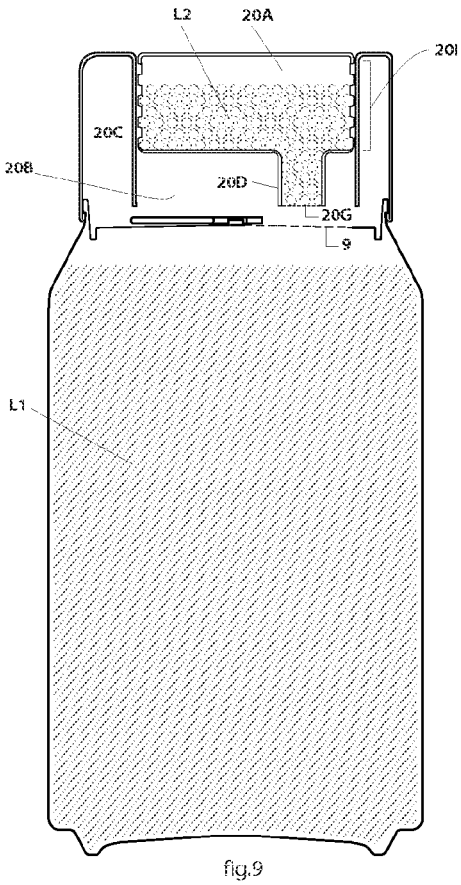
FIG. 9 is an enlarged, cross-sectional view of the embodiment of FIGS. 7 and 8, showing the attached secondary container with a secondary liquid, to a conventional aluminum can (the primary container) with pop top tab, as shown in FIG. 6 and containing a primary liquid, before the penetrator of the secondary container is actuated to first pierce the frangible seal of the secondary container and then puncture the hull of the primary container or aluminum can.

Description of the invention will now be given with reference to FIGS. 1-37. It should be understood that these figures are exemplary in nature and in no way serve to limit the scope of the invention, which is defined by the claims appearing hereinbelow.

A first embodiment of the invention is shown in FIGS. 2-5. A secondary container or external can-shaped cartridge 10 is capable of attaching to and puncturing a conventional primary container or aluminum beverage can 8 by pushing on and/or through the provided pull top tab 9 of the primary container 8 (see FIG. 1) to combine a substance, a liquid, powder, crystals, and/or the flavoring contents of the secondary container or small can-shaped device 10 with the liquid contents of the primary container or larger, conventional beer, soda, or other liquid-holding can 8. When thus combined, an instant mixed drink is available, preferably for consumption. A secondary container is comprised of a one-chamber cartridge 10 and is provided with internal chamber 10A which is intended to be sold, pre-filled, with a secondary liquid L2 to be mixed with the liquid contents L1 of the conventional, primary container, an aluminum or thin-wall can 8. Secondary container 10, like that of the primary container 8, can be extruded, draw molded or otherwise formed, preferably into a continuous piece of thin metal or plastic to form the housing 10F. The primary container 8 and the secondary container 10 can be formed in different processes, by the same process, from different materials or of the same materials. They should, however, be matingly compatible in size, shape, materials, etc. so that secondary container 10 will non-tippingly sit upon the top, below the bottom or secure to the side and mechanically couple to the primary container 8. If the secondary container secures to the top or bottom of the primary container, it is preferably of the same or a similar profile as the primary container. In one embodiment, shown in FIGS. 2 through 5, the secondary container 10 mechanically grips and in a liquid tight manner seals to the top of the conventional, beer or soda can, namely, primary container 8. In other embodiments, the secondary container couples to the primary container at the base of the primary container or at its side wall. In the embodiment shown in FIGS. 2 through 5, however, the coupling, as mentioned is at the top of the primary container 8 and, in this manner, the conventionally provided pop-top tab 9 is covered by the bottom of the secondary container 10.

In the embodiment shown in FIGS. 2 through 5, the mechanical coupling of the secondary container to the primary container is accomplished by a small circular flange at the base of the secondary container overlapping and catching behind the outer edge of the upper rim 7 of the primary container 8. The outer wall of the secondary container is slightly outwardly resilient to allow the snap-together placement, by downward movement of the secondary container over the top of the primary container, so that the secondary container flexes outwardly, at its outer cylindrical wall, until the two containers are mechanically held together. Once the extra thickness of the flange of the secondary container passes by the outside thickness of the rim 7 of the primary container 8, the wall of the secondary container 10 reassumes its original position, again, a function of the wall's inherent resiliency. A small excess or thickness of the bottom flange of the outer wall of the secondary container serves to prevent accidental removal of the secondary container from the primary container, once the two containers are joined.

The two containers are mechanically held together (as just described) and sealed to one another by the interaction of the base of the secondary container and the top of the primary container. A rubber seal, O-shaped ring or other combination of adhesive and sealing means can be employed to ensure not only the mechanical interlock between the two containers but, in addition, to ensure fluid tightness, i.e., that fluid released by the secondary container will only mix with fluid of the primary container and substantially no fluid will exit the combination at the point of the mechanical interlocking of the components.

A spike or penetrator 10D (which will form a preferably star-shaped or circular hole in the outer wall of the primary container) is provided and associated with the secondary container 10. The bottom of the cylindrical secondary container 10 is preferably provided, i.e., covered with a thin sheet of foil, plastic, or a thin-walled metal membrane 10G. Spike 10D, in this embodiment of general cylindrical shape, is movably disposed for downward sliding within a recess in the secondary container and then removal. The recess is suitably shaped, in the drawings referred to as recess 10B, and it is shaped to contain the spike or penetrator and, yet, allows for downward movement of the penetrator, when desired, and then removal, after the penetrator has accomplished its function, namely, piercing of the thin wall of the base of the primary container. The reciprocal movement of the penetrator within the recess does not, however, allow for liquid to flow between the outside of the penetrator and the inside of the recess, unless the penetrator is first removed. This can be accomplished by precise machining and tolerances and/or by providing a gasket, seal, sticky seals, etc. As can be seen in this embodiment, downward relative movement of the penetrator also serves to break the foil or plastic membrane 10G. After doing so, the distal end continues, as the penetrator is continued in its downward path upon mechanical pressure, to pierce through or push downwardly upon the pop-top tab of the primary container 8.

In those embodiments where the secondary container is placed on top of the primary container, it is preferred to align the penetrator with the pop top tab prior to activating the penetrator. The alignment can be visually accomplished by the user or the bottom of the secondary container, the foil or membrane, etc. can be provided with a slight recess to accept and accommodate the shape and dimensions of the upward projection of the pull top tab of the can. The alignment ensures that the penetrator is located over the pop top tab, which is weakened by score lines, to facilitate the ease of opening of the can when the penetrator is activated.

The spike or penetrator is initially held within the recess 10B and its base covers, in a fluid sealing manner, the bottom aperture or hole 10H of the secondary container 10. The tightness of fit between the spike or penetrator 10D and the cylindrical recess 10B is such that no liquid will easily get through the aperture 10H and then out of the opening of the recess unless and until the spike or penetrator is intentionally removed from the cylindrical recess, which is not intended to occur until after the breakage of the membrane and the opening of the primary container's pop-top tab, when the two liquids are mixed.

In operation, the invention works as follows. Spike 10D of the secondary container 10 is preferably aligned (visually or by mechanical intermeshing of the bottom of the secondary container or the foil membrane 10G with the top of the can 8) with the pull top tab 9 of primary container or beer or soda can 8. Of course, another embodiment can provide for non-alignment being required and, in this embodiment, the penetrator will not merely press down on the pop top tab but will actually comprise a piercing point which will pierce through the top of the can 8. The secondary container 10 is mechanically attached (by pushing it downwardly) towards and onto the top of aluminum can 8 forming a mechanical connection and a watertight seal at annular flange 7. An O-ring, or a similar compressible seal, provided to the bottom of the secondary container (preferably on the inside of the flange at the base of the secondary container) secures the two containers together in a leakless manner. The slight resiliency to the base of the bottom portion of the outside wall of the secondary container allows it to flex around the flange of the primary container and then snap back so that when the secondary container is pushed down on top of the primary container, the two are mechanically coupled and cannot be accidentally separated. Also, as mentioned, the two containers are then in a fluid-tight condition so that liquid from secondary container 10 and primary container 8 will not exit between the mechanical joint located between the two containers.

This embodiment of the invention need not have the secondary container springingly engage or clip around the crimped edge of the top of the primary can for mechanical engagement. Rather, in an alternate embodiment, (similar to that described and shown in relation to FIG. 19) the secondary container can be friction fit to the primary container. This can be accomplished by an annular seal that grips around the outside of the primary container to mechanically and leaklessly hold the two containers together. The inside of the secondary container can be provided with sticky adhesive which serves to hold the two containers mechanically together and, at the same time, the sticky seal will provide a leakless seal between the containers.

When the mixing of the liquids is desired, pressure in the direction of arrow Z (see FIG. 5) is applied to the top of spike or penetrator (10D), which forces the distal or leading tip of the spike 10D to slide downward in the recess and for the tip to first pass through foil membrane 10G (releasing contents L2 of chamber 10A) and then further downward movement on the top of the penetrator causes the distal or bottom tip of the spike or penetrator to then pierce the hull of the primary container. In the preferred embodiment, however, with the penetrator aligned with the pop top tab the penetrator is pushed downwardly on the pre-weakened pop top tab (a consequence of the score lines on the primary container) with such force as to push down upon and open the pop-top tab by pushing it into the chamber of the primary container 8. Whether the penetrator pierces the top of the can 8 or opens the pop top tab, this results in the liquid contents L2 of secondary container or chamber 10A mixing freely with the contents or liquid L1 of primary container or can 8.

In the preferred embodiment, the membrane 10G is first ruptured by movement of the penetrator and then the top of the can 8 pierced or opened. In an alternate embodiment, the elasticity of the membrane 10G can be sufficient to allow for its distensibility such that the membrane will not break until the distal end of the penetrator is first pushed through the pop top tab at which point the membrane is ruptured. The rupturing of the membrane 10G and the piercing/opening of the primary container 8 can also occur substantially simultaneously.

Penetrator or spike 10D is then mechanically removed by pulling it upwardly and out of the recess (see FIG. 4) and the mixed drink (a combination of the liquids L1+L2, from secondary container 10 and primary container 8, respectively) can be consumed and enjoyed since the contents can mix and pass first through the pop-top tab opening of the primary container 8 and then through hole 10H of recess 10B of secondary container 10. Ordinary liquid or drink consumption is possible when the integrated containers are tipped over, in a manner similar to how the liquid from a conventional container is consumed. Of course, a straw (not shown) can be used and can pass down into the main chamber of primary container 8 through the recess 10B, through hole 10H, and through the opening formed by pushing down on the weakened/scored pop-top tab 9 of the primary container 8.

The spike component of the penetrator can be solid, hollow, or perforated in this or the other embodiments. What is important, however, is that the spikes are profiled so as to optimize the puncturing of the hull in the most effortless manner, as well as in a way that provides ample opening in the hull for the mixing of the two liquids. In some cases the spike will be hollow or perforated to maximize flow of liquids between chambers. Also, the tip of the spike can take a variety of shapes and configurations, from star-shaped, to bullet shape, to arrow head, etc. The object is to penetrate the primary container or easily open it up for allowing flow of liquid from the secondary container into the primary container.

Alternatively, spike 10D may be left in place after penetration of the membrane of the secondary container 10 and the pop-top tab 9 of the primary container 8, if the top of the secondary container is provided with its own pop-top tab or another removable and openable closure mechanism. For example, the mixed beverage may be consumed through a hole 10P underneath a removable seal 10R located on an outer or upper edge of secondary container 10.

The shape and material of housing 10F and size of its liquid containing chamber 10A vary according to the contents of the liquid or substance desired to be mixed with other containers and liquids held in the primary containers 8.

Figure 33:
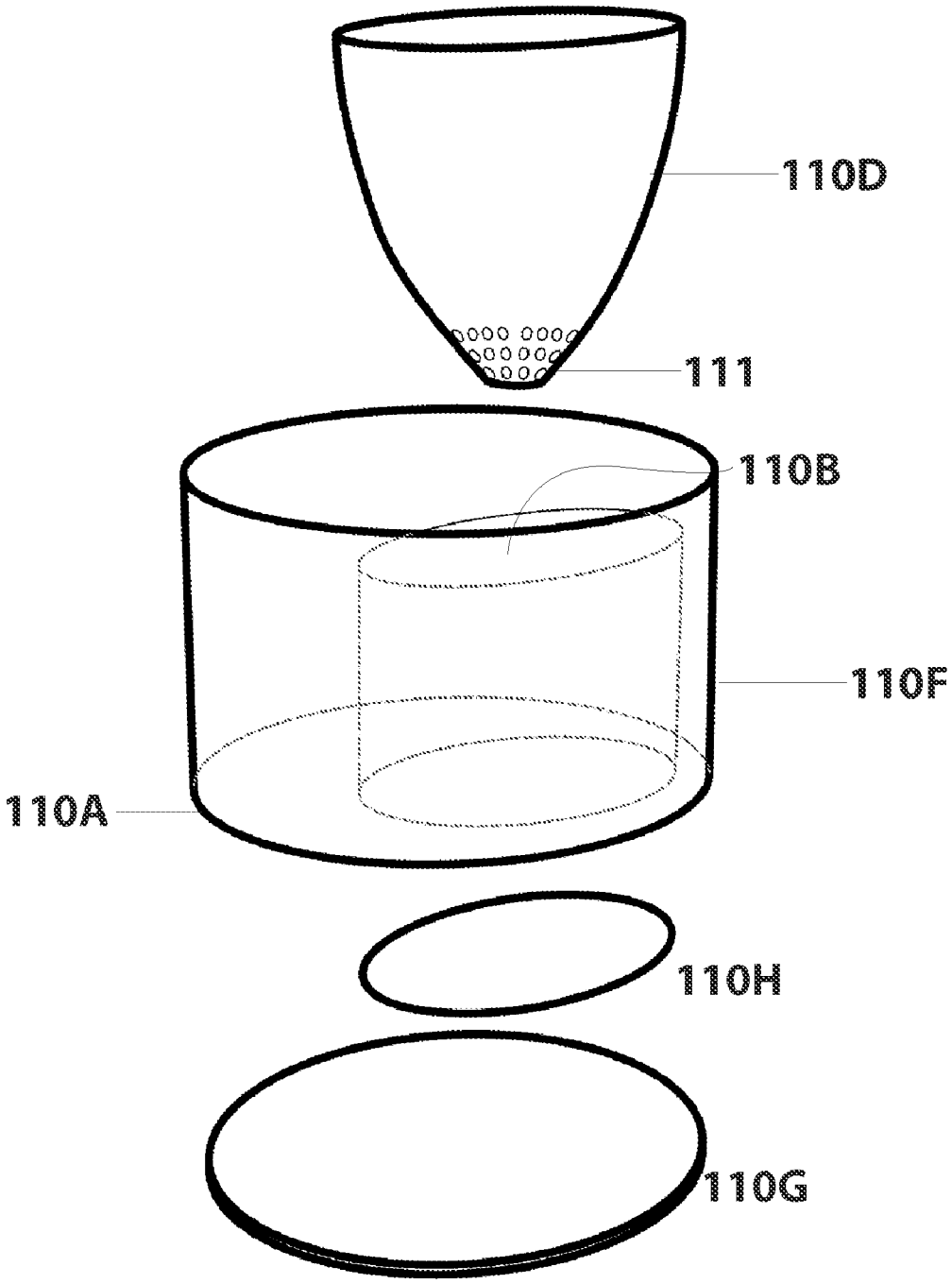
FIG. 33 is an exploded perspective view of a believed more commercially acceptable version of the embodiment of the secondary container shown in FIGS. 2-5.
Figure 34:
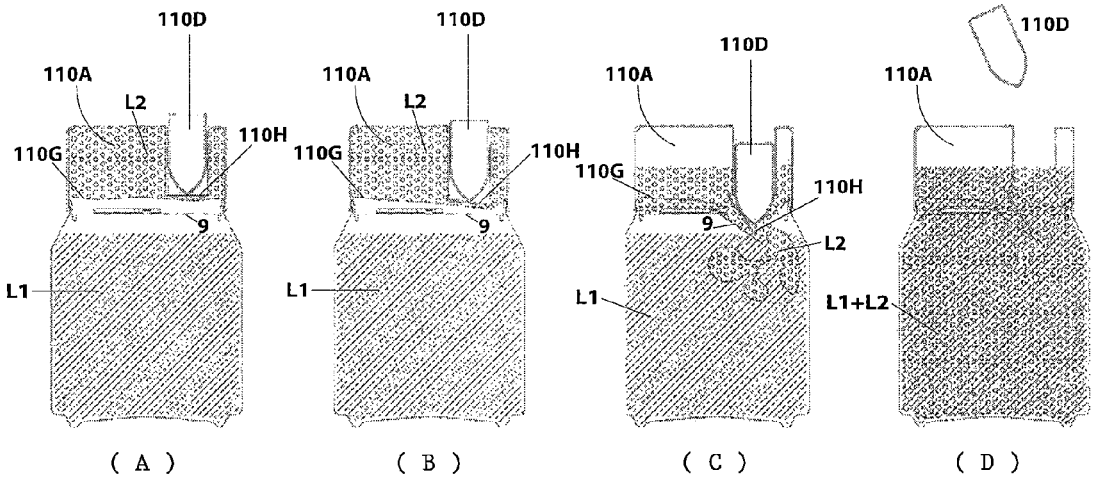
FIGS. 34(A) through -34(D) are a series of cross-sectional views of the device shown in FIG. 33, in various stages of use.

A commercially acceptable version of the first embodiment (where the secondary container is attached to the top of a conventional, beer or soda can, the primary container 8) is believed to be shown in FIGS. 33 and 34 as cartridge or secondary container 110. Here, penetrator or spike 110D is hollow and tapered from top to bottom such that each horizontal cross-section is an ellipse. Initially, the top of spike 110D is closed off with a removable seal or cover to facilitate movement of the spike within the recess and, after mixing of the liquids, to allow for the liquid to be consumed through the hollow shell of the spike. The recess for holding the spike is configured to allow for downward movement of the spike and then removal after the spike has served its function. The spike or penetrator 110D is movably disposed within recess 110B of housing 110F. The leading or bottom/distal tip of the spike or penetrator 110D is designed to puncture the top of the can or the scored/perforated/weakened push top tab or the thin-walled hull of a typical beverage can (although it may simply push the pop-top tab inwardly into the primary container in a manner similar to operation of conventional pop-top tabs when they are actuated). Spike 110D is preferably provided with a set of perforations 111 at its bottom or tip to facilitate the mixing and movement of the liquid contents L2 of secondary container 110 with the liquid L1 of the primary container or can 8. A first seal 110H is formed at the base of the recess 110B for the secondary container 110 and a separate frangible membrane 110G is provided at the bottom of the secondary container. Spike 110D is preferably formed from aluminum or injection molded plastic but could be formed from any sufficiently durable, rigid, and non-toxic material.

Housing 110F is preferably about the same external diameter as the diameter of the primary container 8 upon which it is intended to sit and mechanically and selectively couple.

In use, the spike 110D is first visually or mechanically aligned, when the two containers are initially coupled, such that the scored pop top tab 9 of primary container or beer/soda can 8 is directly beneath the tip 111 of the spike 110D. When the containers are suitably pressed together and mechanically coupled, a liquid tight seal is provided between the bottom flange of the secondary container and the raised rim or flange 7 of the primary container or can 8 by cooperation of a seal, an O-ring, a sticky seal or a compressible seal, on the inside lip of the base of the secondary container and its mechanical cooperation or interaction with the outside rim or flange 7 of the top of the primary container 8, facilitated by the slight resiliency of the base of the outside wall of the secondary container. In effect, the secondary container 10 is snapped down over the rim 7 of the primary container and, once located, mechanical separation is difficult since the slight overlap of the bottom edge of the secondary container 10 will grab and hold onto the downward directed extra flange thickness of the upper rim 7 of the primary container 8. Housing 110F is preferably made from stamped aluminum.

Just beneath recess 110B is a first or upper seal 110H, the first seal to be punctured by spike 110D when mechanical pressure resulting in downward movement is applied thereto (see FIG. 34B). Seal 110H initially seals off the bottom of recess 110B and the perforations of the spike from the liquid within the secondary container. That liquid is located, initially, between the inner surface of the outer wall of the secondary container and the outside surface of the wall of the recess for the spike. Below the initial membrane 110H is a second or lower or main seal 110G, the second seal being then punctured by continued movement of the spike 110D when manual pressure is applied downwardly to the top of the spike. Continued downward movement of the spike results in the piercing of the top of the primary container 8 or the inward opening of the pop top tab of the primary container, a beer/soda can.

Thus, it will be appreciated that with this embodiment, there are three seals or membranes which will need to be breached before the liquids can be mixed. Seal 11H, Membrane 110G and then the top of the primary container all need to be ruptured for liquid L1 of primary container 8 and liquid L2 of secondary container 8 to be mixed. Piercing seal 110G releases the contents L2 of secondary container 110, i.e., from chamber 110A to mix with the liquid contents L1 of the primary container 8. The first seal 110H is provided to ensure that no liquid flows out of the secondary container 110, through the holes in the tip 111 of the spike or penetrator 110D until the liquids of the two containers are mixed together. This embodiment does not require a seal between the outside wall of the spike or penetrator and the inside wall of the recess through which the spike or penetrator moves.

As downward and mechanical pressure continues to be applied to the proximal or upper surface of spike 110D, the distal tip 111 or lower portion pushes against and pierces the membrane 110G and then the upper wall or top of the hull of the primary container or, preferably, if properly aligned, the spike will push down on the scored pop top tab 9 of can 8, thereby opening the can (FIG. 34C) and allowing the liquid contents L1 of primary container 8 to mix with the liquid contents L2 of the secondary container 110D (see FIG. 34C). This is accomplished once the primary and secondary seals 110H and 110G are first ruptured, respectively, of the secondary container 110 and then the top of the primary container 8 is breached.

With the three membranes breached, the fluid from the secondary container can mix with the fluid of the primary container. After the mixing of the liquids L1 and L2 is accomplished, the cover of the spike or penetrator 110D can be removed and the spike, itself, serves as the fluid opening for fluid consumption since the spike or penetrator of this embodiment is hollow. Alternatively, it can be removed from the recess to provide an opening for removal of the mixed beverage (FIG. 34D) either by inverting the combination containers and sipping through the recess 110B or by use of a straw (not shown) or by sipping from the integrated containers through another opening, originally provided with a removable seal or cap.

Another embodiment of the invention appears in FIGS. 7-10. Here, a secondary container 20 is capable of first attaching to and then, selectively puncturing an aluminum beverage can or primary container 8 through the hull of the can or by opening the pull-top tab 9 to allow for the desired combination of liquid contents L2 (of secondary container 20) and L1 (of primary container 8). This desirably results in an instant mixed drink.

Secondary container 20 is substantially the same outside diameter as the diameter of the necked-down primary container 8 and is adapted to mechanically engage and secure to the primary container 8 much in the same manner as the embodiment shown in FIGS. 1 through 5. Here, too, the containers mate in a mechanical and substantially leak-proof manner. The mechanical and fluid-tight sealing of the two containers can either be by the gripping of the bottom flange of the secondary container to the upper rim of the primary container and an O-ring, or by a sticky seal interengaging the elements, or by another suitable mechanism(s).

In this embodiment, secondary container 20 includes two chambers. The secondary container 20 basically comprises a pair of spaced parallel and concentric walls which define a ring-like outer chamber 20C and an interior circular chamber 20B. The interior chamber or recess is provided with a collapsible, bellows-like primary can penetrator element 20A which also serves as a chamber to initially hold the secondary liquid L2. The penetrator 20A is disc-like with a downwardly protruding/extending tube 20D extending from its bottom. The penetrator 20A is comprised of a top surface parallel to the top of the primary container when the devices are assembled, a set of collapsible side walls or bellows-(circular) and a round bottom or floor, also parallel to the top of the can 8. A downwardly protruding tube or spike 20D extends from the bottom or floor. The spike is tube like, downwardly extending and sealed with a lower membrane 20G. The secondary container 20, in the penetrator 20A initially holds liquid L2 to be mixed with the contents L1 of the primary container or aluminum can 8. As a consequence of the resiliency and construction of the bellows, the penetrator 20A is vertically compressible within the interior chamber 20B when the top is pressed downwardly so that the bottom of the penetrator is pressed against the upward force provided by the top of the primary container 8. The cylindrical penetrator 20A is held within the interior circular chamber or recess 20B. The outer chamber 20C is designed to contain the overflow of the combined contents L2 of the secondary container and the liquid L1 of the primary container 8. Mixing or outer chamber 20C (the annular outer chamber formed by the parallel and circular walls) is closed off by a top wall 20R. The penetrator 20A is provided, around its entire perimeter, with crumple zones or bellow-like outer walls 20I which, when pressure is manually applied to the top of the penetrator 20A will vertically collapse the volume of the penetrator. The bottom wall of the penetrator will, when the penetrator is pushed downwardly, abut against the top surface of the primary container 8. This abutment will cause the penetrator to collapse at its bellows or crumple zone. Then, with further pressure being exerted on the top of the penetrator, the membrane 20G will break from the liquid pressure within the penetrator and the decreased volume of the bellows. As the bellows or crumple zone 20I further collapse the spike of the penetrator will penetrate the hull (or push down on the pop-top tab 9 if the tube 20D is properly aligned with the pop top tab) and cause the spike to project into the volume of the primary container 8, to open up the fluid path between the primary container 8 and the liquid contents of the secondary container 20. The liquid within the primary container, L1, will start to mix with the liquid L2 of the secondary container 20 in the mixing zone of 20I.

This embodiment requires the outside diameter of the bellows-like walls to be about the same as the inside diameter of the inner annular wall of the outer chamber (in effect the inside of the inner chamber or recess) and, yet, the penetrator must be able to slide downwardly within the inner chamber to compress the crumple zone. Again, there should be sufficient fluid sealing between the outside of the crumple zone walls and the wall of the inner chamber to ensure that minimal, if any, liquid passes between the two relative moving components, especially after the membranes are punctured.

In operation, this embodiment works as follows. First, spike 20D is aligned (visually or mechanically) with the scored or weakened pop top tab 9 of primary container or beer or soda can 8. Secondary container 20 is then mechanically coupled to the primary container 9. The mechanical coupling and the seal of the two containers in this embodiment is substantially the same as shown in FIGS. 1 through 5. The top of primary container or aluminum can 8 forms a mechanical coupling and a watertight seal with the secondary container at annular flange or rim 7. Again, some resiliency in the outside edge of the secondary container 20 can be used to accomplish this or the use of a sticky seal can be employed. The resiliency of the outer wall of the secondary container will allow it to be snapped onto the top of the primary container and then, once in place, will minimize accidental or premature removal.

Figure 10:
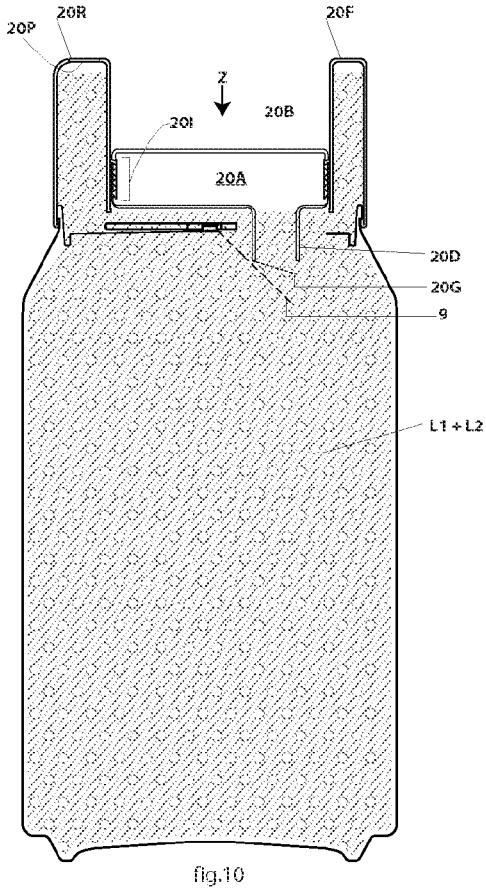
FIG. 10 is a cross-sectional view of the embodiment of the invention shown in FIGS. 7, 8 and 9, showing the secondary container attached to a primary container, an aluminum, pop top tab can, with the liquids of the respective containers mixing, after the frangible seal of the secondary container is pierced by the mechanical penetrator and the pop top tab opened by continued depression of the penetrator, and also showing the penetrator being depressed to collapse the bellows of the secondary container to cause mixing of the liquids of the containers.
Figure 11:
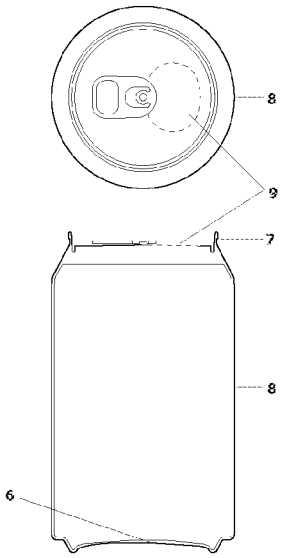
FIG. 11 is a side, cross-sectional and top view of a conventional aluminum can, the primary container, with conventional shape, pop top tab, and base and top substantially as shown in FIGS. 1 and 6, but repeated here for illustration of another embodiment of the invention, the secondary container as set forth in FIGS. 12 through 15.
Figure 12:
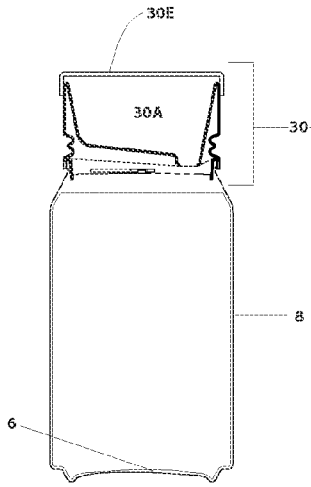
FIG. 12 is a cross sectional view of a third embodiment of the invention, a secondary liquid container, attached to an aluminum can, the primary container, as shown in FIG. 11.
Figure 13:
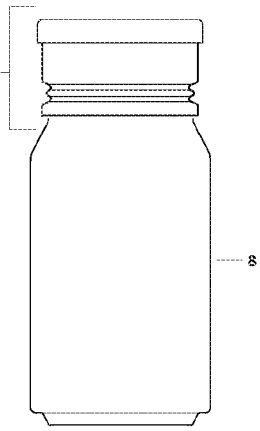
FIG. 13 is a perspective and elevational view of the third embodiment of the invention, similar to that shown in FIG. 12, showing the secondary container attached to the top of a conventional aluminum can of the type shown in FIG. 11.
Figure 14:
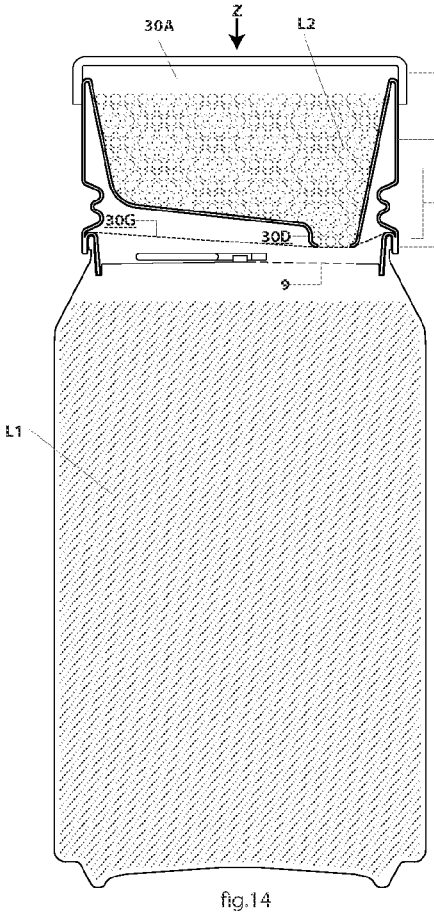
FIG. 14 is an enlarged, cross-sectional view of the embodiment of FIGS. 12 and 13, showing the attached secondary container with a secondary liquid, to a conventional aluminum can (the primary container) with pop top tab, as shown in FIG. 11 and containing a primary liquid, before the penetrator of the secondary container is actuated to first pierce the frangible seal of the secondary container and then puncture the hull of the primary container or aluminum can, and also showing the secondary seal of the secondary container in place.
Figure 15:
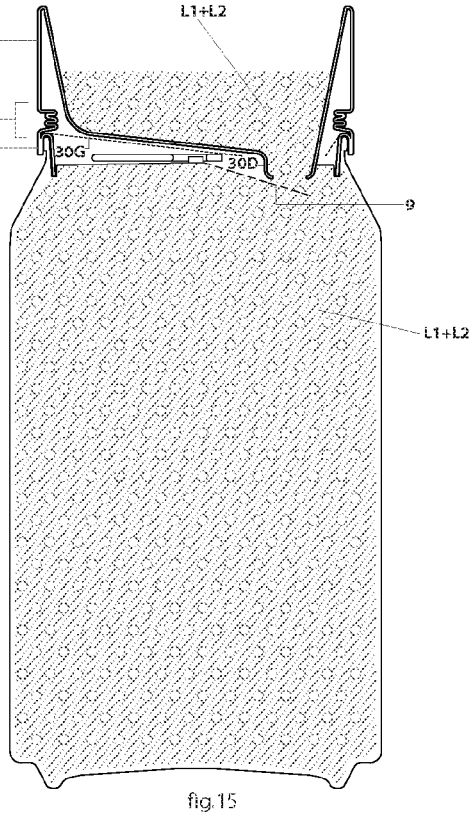
FIG. 15 is an enlarged cross-sectional view of the embodiment of the invention shown in FIGS. 12, 13, and 14 and showing the secondary container attached to a primary container, an aluminum, pop top tab can, with the liquids of the respective containers mixing, after the frangible seal of the secondary container is pierced by the mechanical penetrator and the pop top tab opened by continued depression of the penetrator, and also showing the penetrator being depressed to collapse the bellows of the secondary container to cause mixing of the liquids of the containers and also showing the removal of the secondary seal of the secondary container.
Figure 16:
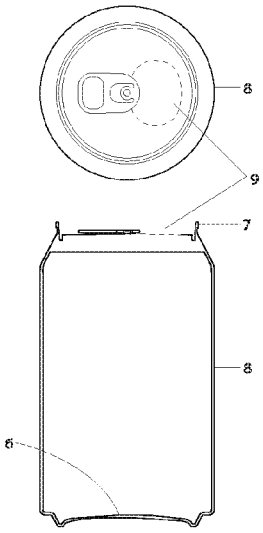
FIG. 16 is a side, cross-sectional and top view of a conventional aluminum can, the primary container, with conventional shape, pop top tab, and base and top substantially as shown in FIGS. 1, 6, and 11, but repeated here for illustration of another embodiment of the invention, the secondary container as set forth in FIGS. 17 through 20.
Figure 17:
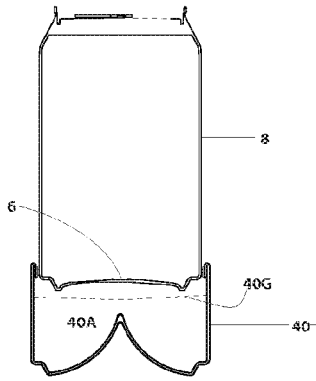
FIG. 17 is a cross sectional view of a fourth embodiment of the invention, a secondary liquid container, attached to an aluminum can, the primary container, as shown in FIG. 16.
Figure 18:
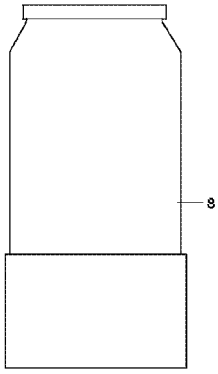
FIG. 18 is a perspective and elevational view of the fourth embodiment of the invention, similar to that shown in FIG. 17, showing the secondary container attached to the bottom of a conventional aluminum can of the type shown in FIG. 16.

When a mixing of the two liquids is desired, thumb or mechanical pressure in the direction of arrow Z (see FIG. 10) is applied to the top of the penetrator 20A within the inner chamber or recess 20B, causing spike 20D to puncture through the hull of the can or to move the pop top tab 9 into the position shown in FIG. 10. As further mechanical pressure is directed downwardly in direction of Z, to the top of the penetrator element, bellow walls 20I in the crumple zone, collapse, by interaction of the top of the primary container 8 and the bottom of the penetrator. An inwardly directed flange on the recess 20B can also resist the downward movement of the bellows and thus cause the bellows to compress as the top of the same is pushed down. This ensures that the liquids, when released can be directed into the mixing chamber 20C.

Collapsing of the volume of the chamber, with the incompressible liquid L2 therein, causes the membrane 20G to rupture as a consequence of the incompressibility of the liquid. The downward movement of the tube 20D causes the piercing of the top of the can 8 or, as mentioned, can result in the opening of the pop top tab. Once the chamber with the liquid L2 is opened, the liquid L2 of the secondary container 20 can mix with the contents L1 of the primary container, the aluminum can 8. This liquid mixing can take place in the outer annular chamber 20C. Fluid can flow between the top of the primary can 8 and the bottom of the bellows and into the mixing chamber. Since the contents L2 of chamber 20A plus the contents L1 of can 8 are typically greater than the total volume of can 8 (even taking into consideration the small void volume in conventional beverage cans), the overflow liquid passes into annular mixing chamber 20C.

As above, in one version of this embodiment, after mixing, the penetrator is then removed, and the mixed drink (L1+L2) may be enjoyed through sipping from the now-vacated recess 20B or the inner chamber 20B or by a straw placed though the now-open pop top tab area. Alternatively, the penetrator can be left in place and the outer chamber or housing or mixing chamber 20C may be provided with a selectively openable top or side opening 20P (see FIG. 10) at the proximal or upper surface, covered by a removable seal 20R. In this version, one would remove seal 20R and drink the mixture via opening 20P or place a straw therethrough to access the now mixed beverage, formed from liquids L1 and L2. The seal between the crumple zone 20I and the inside wall of the recess 20B would prevent the leakage of fluid therebetween, which seal may be enhanced by the physical crumpling of the penetrator.

The dimensioning of the elements including the length of the spike 20D and that of the height of the inner chamber allows for the spike to first penetrate the primary container 8 before the crumple zone starts to collapse the volume of the chamber with liquid L2. This ensures mixing of the liquid contents after the primary container is pierced and thus substantially only mixed fluids will end up in the mixing or outer chamber 20C. The spike length and the elasticity of the membrane 20D can be designed so that the membrane will not rupture until after the volume of the penetrator is decreased, a result of the crumpling of the device by interaction of the bottom of the penetrator with the top of the primary container or with an interiorly directed flange secured to the side wall of the recess.

As in the first embodiment, the shape and material of the penetrator 20A, the inner chamber or recess 20B, and the size and shape of the outer chamber 20C vary according to the contents of container 20 and the shape of primary container or can or bottle 8. For example, mixing chamber 20C need not be annular disposed around internal chamber 20A but can be along one side of it, contained within it, in a 'yin-yang' relationship, or any other mechanical configuration which satisfies the functional criteria.

A third embodiment of the invention is shown in FIGS. 12-15. As above, secondary container or device 30 is capable of attaching to and puncturing the top of primary container 8 or an aluminum beverage can 8 through the hull of the can, through the pop top tab or by pushing and separating the scored and weakened pop top tab 9 from the top of the can. This is intended to combine liquid contents L2 of secondary container 30 and liquid contents L1 of primary container or can 8 into an instant mixed drink (L1+L2). Similar to the embodiment shown in FIGS. 1 through 5, here, the secondary container 30 is a one-chamber device for the liquid L2. This is intended, when and where desired, to allow for mixing with a primary liquid L1 held within an initially sealed primary container or aluminum can 8 (see FIG. 11). Secondary container 30, in this embodiment, is generally round and formed from thin-walled plastic, rubber, metal or other suitable material. Its outer diameter is about that of the outer diameter of the top, necked down portion of the primary container 8. This secondary container 30, too, is adapted to matingly and mechanically engage the top of the primary container 8 and to do so in a substantially leak-proof manner. Again, a slight resiliency of the outer wall of the secondary container can be provided and would allow for the snapping on of the secondary container to the primary container and the mechanically coupling of the two components at or about the rim 7 of the primary container 8. The bottom edge of the secondary container 30 is adapted to allow it to slip onto the upper rim 7 of the primary container 8 and to prevent accidental removal. A sticky seal can be substituted provided substantial mechanical coupling is provided and, at the same time, doing so in a leakproof manner.

A seal is provided between the two containers to ensure that when the two containers are opened fluid will not leak out through the mechanical coupling of the flange of the secondary container and the rim of the primary container.

Secondary container 30 is formed by a continuous piece of metal, rubber or plastic housing 30F sealed at its top by removable cap or piercable or removable membrane 30E. The secondary container 30 has a basic cylindrical-like outside shape with smooth outer walls and a small crumple zone near the base of the cylindrical outer wall. The top rim of the secondary container, at the location where the cap or seal 30E is provided, slopingly continues downwardly and inwardly to provide a sloped inside wall like a funnel and a small spike like piercing element, like the spout of the funnel. The bottom end of the spike like piercing element is initially provided with a membrane to maintain liquid L2 within the chamber defined by the sloped inside walls, the sealed top 30E and the bottom wall, terminating at one side in the spike like element 30D. A principal difference between this embodiment and the previous two embodiments are that chamber 30A is an open structure, being only covered or sealed off by cap or membrane 30E. Spike-like piercing element 30D (see FIG. 15) is formed as a downwardly open, projecting element integral with housing 30F and a continuation of the inside sloped walls of the secondary container 30. This embodiment, like the others, can be provided with perforations or holes through the end of the spout or spike like element to facilitate fluid mixing and removal for consumption.

In use, secondary container 30 operates as follows: first, the spike-like and spout element 30D is visually or mechanically aligned with the scored or weakened pop top tab 9 of primary container or conventional beer or soda can 8. The bottom can be provided with a recess which is shaped to accept the upwardly extending profile of the pop top activator so that the secondary container is precisely nested upon and in alignment with the opening of the primary container. Secondary container 30 is then snap attached (or by use of a sticky seal) to the top of the aluminum can 8 by pushing the two components together, such that the bottom edge of the secondary container flexes over (by its resiliency) the upper rim 7 of the primary container to thereby mechanically couple the components. Alternatively, the secondary container can simply slide over the upper rim of the primary container by a sticky-like seal or adhesive coupling. The overlap of the bottom edge of the secondary container and the outside edge of the top rim of the primary container 8 can hold the two components together, once coupled. A fluid-tight seal is also provided, whether by an O-ring, a sealant, a sticky seal or other sealing mechanism.

Then, when a mixing of the two liquids (L1 and L2) is desired, the user will apply mechanical downward pressure on the top 30E to force the spike-like element 30D downwardly. When the bottom of the spike-like element 30D is pushed down on the pop-top tab 9 (or if not so aligned on the top of the primary container 8) it will either cause the primary container 8 to open at the pop-top tab (See FIG. 15) or the spike-like element will puncture a hole through the hull (through the top of the container) of the can 8. Further downward pressure applied to the top of secondary container 30 (either on cap 30E or around the upper rim of housing 30F) in the direction of arrow Z causes crumple zone 30I to start to collapse. This is a consequence of the bottom of the chamber or funnel shape abutting against the top of the primary container 8 and the designed and inherent weakness of the crumple zone 30I. The crumple zone is proximal the base of the funnel shape so that the spike first pierces the primary container before the volume of the secondary container is compressed. When collapsed by the further application of mechanical pressure, the membrane or foil 30G of the secondary container breaks (as a consequence of the incompressible fluid being contained in a now smaller volume) thereby releasing the liquid contents L2 of chamber 30A into the primary container 8. The liquid contents can then mix.

In summary, downward mechanical pressure on the top 30E causes the spike-like element 30D to poke the scored or perforated pop top 9 of can 8 or for the spike to pierce a hole through the hull of the primary container, breaking the seal on the beverage can and, further mechanical pushing in the direction of Z, causes a decrease in the volume of the chamber of the secondary container 30, which, with the incompressible fluid or liquid L2 within, causes the seal on the bottom of the secondary container to rupture. The membrane 30G, in the preferred embodiment, extends across the end of the spout 30D. The crumple zone compresses as a consequence of the continued downward pushing on the chamber and the interaction of the bottom wall of the secondary container becoming flush upon and contacting the top surface of the primary container or can 8. With both the chamber 30A and the liquid therein L2 having a free path to the chamber of the primary container 8 and its contents L1, the liquids can mix together.

Then, when it is desired to consume the contents, the cap 30E or another membrane or foil-like seal can be removed for sipping the mixed beverage. The cap can be replaced, if the beverage is desired to be consumed over time. If only a portion of the drink is consumed and it is desired to still maintain the mixed drink, the cap 30E can be replaced as it is desired that the same is frictionally or mechanically held onto the upwardly extending top edge of the secondary container.

This embodiment may include any number of variations. For example, cap 30E may be replaced by a thin-walled metal top and a pull tab top, an opening with a removable foil seal, or any other suitable air-tight seal. An opening for a straw can be provided and even a self-contained straw. Similarly, since all of the liquid contents of chamber 30A will be dispensed via spike-like element 30D (acting as a spout to the basic funnel shape) membrane 30G can either extend across the entire bottom of the secondary container 30 or merely extend across the small opening of the spike-like, downwardly protruding spout 30D.

A fourth embodiment is shown in FIGS. 17-20. Here, secondary container 40 is capable of attaching to the bottom 6 of the primary container 8, an aluminum beer or soda can or a plastic bottle (not pictured) to combine the liquid contents of both secondary container 40 (L2) with the liquid L1 of the primary container 8, into an instant mixed drink. The secondary container 40 of this embodiment is a one-chamber device having chamber 40A which contains a substance, like liquid and/or powder L2 to be mixed with the contents L1 of aluminum can 8. Secondary container 40 is formed into a housing from a continuous piece of metal, rubber, or plastic, etc. The outer wall and bottom of the device 40F can be formed from a thin sheet of material. The secondary container 40 is generally cylindrical on its outside and provided with an interior diameter slightly greater than the outside diameter of the primary container 8 to which it is selectively attached. The secondary container 40 is provided with a base which resembles, in cross section, opposed upwardly and inwardly sloped walls, meeting in the center at a spike 40D and, yet, having an annular support base for the device so that it can stably sit on a table or other horizontal flat surface.

The top edge of the secondary container 40 of this embodiment is provided with an inwardly-biased upper cylindrical member with an inwardly directed seal 40S which when the device is slid over the bottom of a primary container or aluminum beverage can 8 will mechanically hold onto the sides and over the bottom of the can and, in addition, provides a degree of leakproofness, as well. A sticky seal or O-ring can be provided/housed inside the top edge of the secondary container to provide the leak-proof characteristic to the device when secured over the bottom of the primary container. A membrane, 40G extends across the top of the secondary container 40 and serves to initially maintain the liquid L2 within the chamber portion 40A of secondary container 40. The membrane can be a thin metal foil or plastic and can also be provided with a more secure top cover (not shown) which protects the membrane until the device is inserted over the bottom of the primary container.

The bottom surface of the secondary container 40 projects upwardly from its sides and inwardly towards a central peak 40D to form a relatively sharp spike or penetrator. In alternate embodiments, the spike need not be centrally located and, in fact there may be advantages to the penetrator or spike being off center. According to the invention, the spike or penetrator can be centrally located, off center, or can be comprised of a set of spikes for piercing the skin or hull of the primary container.

As mentioned, ring seal 40S is provided to enable secondary container 40 to be slid over, secured and sealed tightly over the lower portion or base of can 8. Membrane 40G serves to enclose the liquid contents, L2, of container 40 until the secondary container is put into use.

In operation, the primary container is slid into the open end of the secondary container. This is made easy by locating the base of the secondary container on a table top. Of course, the relative sliding of one component, the primary container, with respect to the receiving component, the secondary container, can be done by manual pressing of the containers together, i.e., between one's hands.

The upwardly extending cylindrical ring with ring seal 40S forms a watertight and friction coupling with outer side wall of container 8. Downward relative pressure applied to the top of the primary container 8, (or movement of the secondary container over the bottom of the primary container or by pressing, by hand, the two components together) with the secondary container 10 located over the bottom of the primary container, causes the spike-like element or central peak 40D, to piece the bottom or hull of the aluminum can 8. This can easily be accomplished by placing the secondary container over the bottom of the primary container and then placing the two on a table top, with the secondary container directly on the table top. The annular base of the secondary container holds the coupled containers stably in an upright orientation. The outer shell of the secondary container is used as a stabilizer to align the two containers and enables the combined containers to stand upright even though the bellows (see FIG. 36) may be flaccid.

Figure 19:
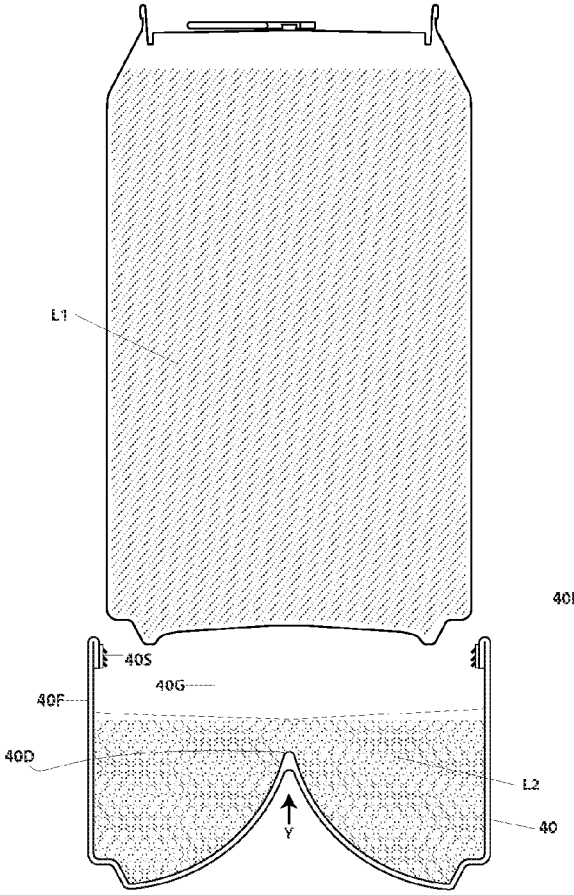
FIG. 19 is an enlarged, cross-sectional view of the embodiment of FIGS. 17 and 18, showing the secondary container with a secondary liquid, about to be attached to a conventional aluminum can (the primary container) with pop top tab, as shown in FIG. 16 and containing a primary liquid, and also showing the frangible seal of the secondary container in place.
Figure 20:
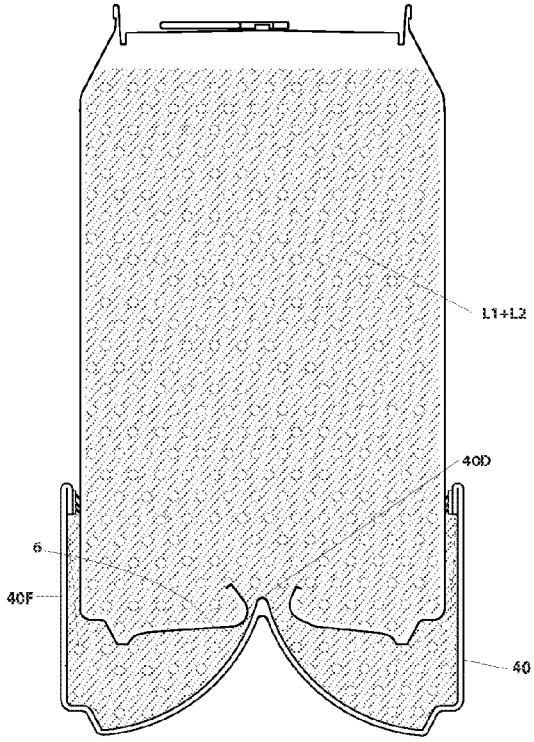
FIG. 20 is an enlarged cross-sectional view of the embodiment of the invention shown in FIGS. 17, 18, and 19 and showing the secondary container attached to the bottom of a primary container, an aluminum, pop top tab can, with the liquids of the respective containers mixing, after the frangible seal of the secondary container is pierced by the mechanical penetrator.
Figure 21:
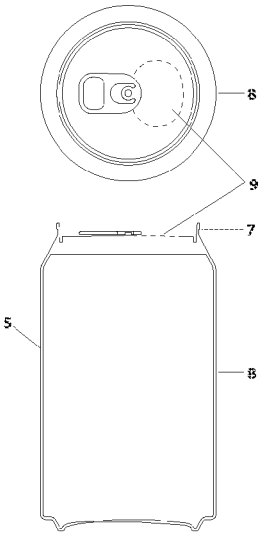
FIG. 21 is a side, cross-sectional and top view of a conventional aluminum can, the so-called primary container, with conventional shape, pop top tab, and base and top substantially as shown in FIGS. 1, 6, 11 and 16, but repeated here for illustration of another embodiment of the invention, the secondary container as set forth in FIGS. 22 through 27.
Figure 22:
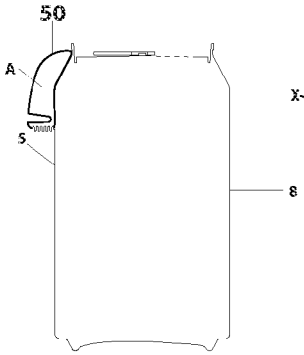
FIG. 22 is a cross sectional view of a fifth embodiment of the invention, a secondary liquid container, attached to the side of a conventional aluminum can, the primary container, as shown in FIG. 21.

Then, relative downward movement of the primary container, depicted in FIG. 19, against the force of the table top, or relative movement of the secondary container 40 with respect to the primary container 8, (in the direction of arrow Y) forces the spike-like element or penetrator 40D upwardly and piercingly through the bottom 6 of can 8. The mechanical movement of the primary container with respect to the secondary container 40, i.e., the sliding of the can within the chamber defined by the secondary container causes the membrane 40G to rupture when the bottom of the primary container passes through the membrane. The dimensioning of the secondary container is such that the relatively long and high reaching spike first pierces through the bottom of the primary container and then, after the hole is formed for fluid passage, further relative sliding movement of the two containers causes the incompressible liquid L2 in the secondary container to come under pressure which is relieved by the rupturing of the membrane extending across the secondary container. This pressure on the chamber of the secondary container is provided by the bottom of the primary container pushing against the secondary container with the liquid not being able to flow out of the system because it is sealingly maintained by the seal 40S. Thus, the membrane erupts and the two liquids mix together through the hole formed by the spike in the bottom of the primary container.

The components are dimensioned to desirably ensure that the rupture of the membrane occurs after the piercing of the bottom of the primary container is accomplished. This membrane rupturing and the rupturing of the bottom of the primary container 8 allows the contents L1 of primary container or can 8 to mix with the liquid contents L2 of the secondary container 40. When it is desired to drink the mixed drink, the pop-top tab 9 of the primary container 8 is opened, and the mixed drink is consumed in a conventional manner.

Figure 35:
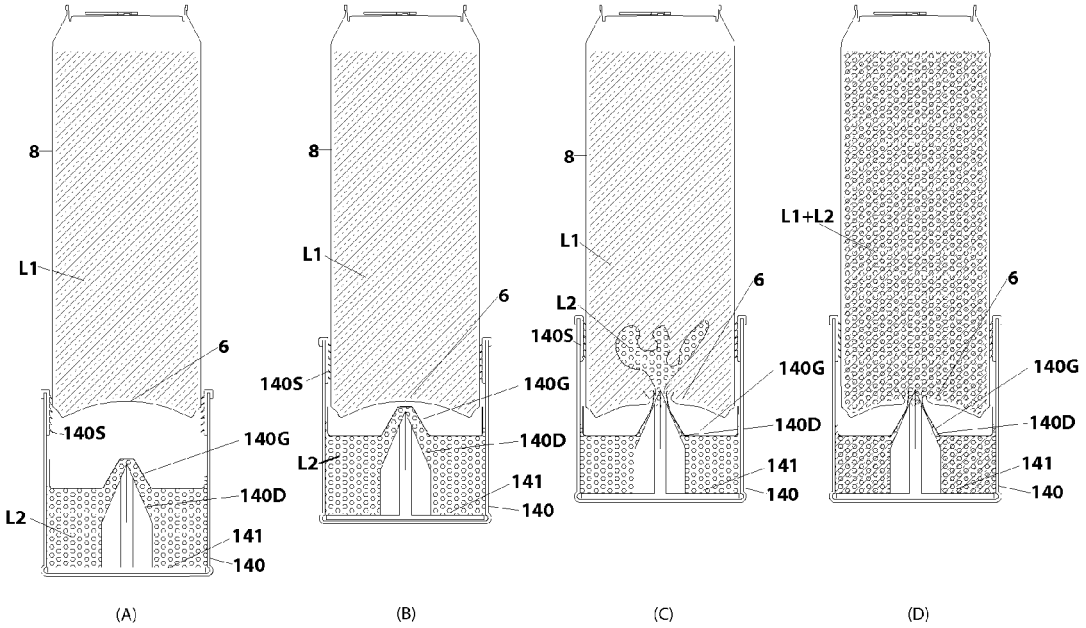
FIGS. 35(A) through (D) are a series of cross-sectional views of a believed more commercially acceptable version of the embodiment of the secondary container as shown in FIGS. 17-20.
Figure 36:
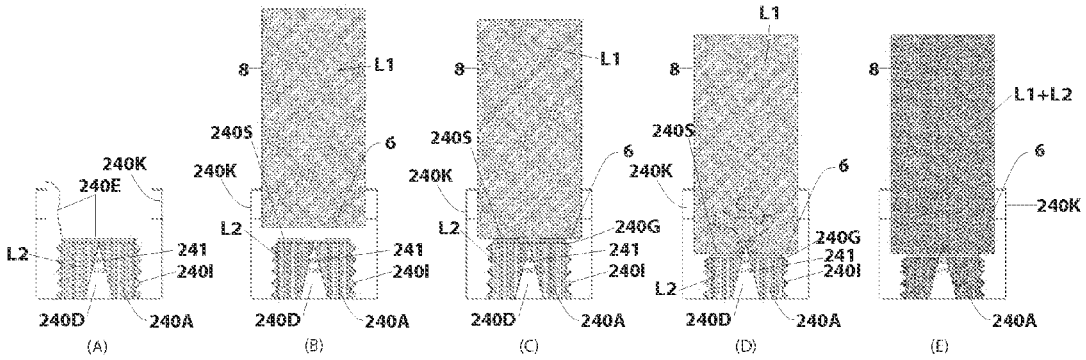
FIGS. 36(A) through (E) are a series of cross-sectional views of another believed commercially acceptable version of the embodiment of the secondary container shown in FIGS. 17-20.

Two more believed commercially-acceptable versions of this embodiment are depicted in FIGS. 35 and 36. In FIGS. 35(A) through (D), secondary container 140 is substantially similar to the secondary container 40. Membrane 140G is similar in function to membrane 40G but has a profile which follows that of the tip of the penetrator/spike-like element 140D. The upper edge of the secondary container has a ring seal 140S which is substantially similar to ring seal 40S (it can be an O-ring or a sticky seal). Its function is to ensure against fluid leakage once the membrane 140G and bottom 6 of primary container 8 are punctured.

One chief distinction between these two embodiments concerns the penetrator. In the secondary container 140, spike-like element or can penetrator 140D is a molded separate piece (integrated with the secondary container) from the housing for the secondary container and includes a base 141 secured to the floor of the secondary container 140. The spike like element is like an upwardly extending and centrally located arrowhead (2, 3 or 4 pointed) with a wide, circular base sitting on the floor of the secondary container. Of course, other designs can be used and, indeed, the tip of the spike may not be centrally located. When the primary container 8 is moved downwardly with respect to the secondary container, the spike-like element 140D will pierce the bottom of the can and continued relative downward movement of the primary container will also cause the rupture of the membrane of the fluid-holding membrane in the secondary container. Then, the two liquids, L1 and L2 will mix. The operation of the embodiment shown in FIGS. 35A-D is substantially identical to that of FIGS. 17-20.

FIGS. 36(A)-(E) depicts another bottom-mounted embodiment for the secondary container with respect to the primary container. Here, a secondary container 240 is depicted, again, a generally cylindrical device with a center-located piercing spike 240D (although off-center spikes may be used) and contained within a bellows-like fluid-holding chamber 240A, all housed within a larger cylindrical segment. The larger cylindrical segment is provided with an upwardly extending, cylindrical, primary-can-capture section and a set of interiorly directed flanges 240K which frictionally grip the bottom and side wall of the primary container. The capture section slides over the bottom of the primary container 8. The guide flanges 240K are adapted to mechanically grip the bottom of a primary container 8 and, yet, in this embodiment they need not do so in a substantially leak-proof manner. Rather, a seal 240S at the top of the chamber (defined by the collapsible bellows 240I) for liquid L2 is provided. In an alternate embodiment, however, further leak-proof functionality can be provided by use of sticky sides, an O-ring, or another fluid sealant mechanism on the flanges 240K. Housing 240F of secondary container 240 is substantially rigid and includes at least one upper annular, inwardly directed guide flange 240K which secures the secondary container around the lower portion of can 8 and keeps the primary and secondary container combination stabilized. The outer shell of the secondary container is used as a stabilizer to align the two cartridges and enables the combined cartridges to stand up even through the bellows (see below) are flaccid.

Disposed within housing 240F is internal chamber 240A defined as the inside volume of the bellows section 240I, which contains secondary liquid L2. The top portion of the chamber, i.e., the top of the bellows is an annular and preferably adhesive, compressible seal element 240S that has an adhesive disposed thereon, so that when seal 240S is placed in contact with the bottom 6 of primary container or can 8, it remains firmly in place and compression of the two containers results in a seal between the two containers and their liquid contents. Removable release paper 240E (see FIG. 36(A)) is provided atop chamber 240A to protect the adhesive layer atop seal 240S. It will be removed when the containers are intended to be coupled for use. Spike element 240D, again, like a two, three or four barbed or other shaped arrowhead, projects upwardly from the base of the chamber and has perforations 241 at its tip. It is located within chamber 240A. The side walls of chamber 240A are cylindrical and include a collapsible bellows-like wall 240I.

In operation, the user first removes release paper 240E (FIG. 36A) to expose the adhesive disposed on seal 240S. Secondary container 240 is placed over the bottom of can 8 (FIG. 36B) with the annular guide flanges 240K surrounding the lower outside wall portion of the primary container or can 8. Pressure is applied to the secondary container in the direction of arrow Y (FIG. 36C) (or the primary container is pressed down towards the stabilized and held secondary container; again by use of a table top) so that guide flanges 240K slide up the side of the can 8 and, more importantly, so that seal 240S presses against and engages the bottom 6 of can 8 and remains there, a consequence of the action of the adhesive layer, secured to the top of the chamber 240A and to the bottom of the primary container 8. The two containers can also be coupled by pressing the containers together between one's hands.

As additional pressure and movement of the containers relative to one another is brought to bear on secondary container 240 in the direction of arrow Y (FIG. 36D), the inherent weakness of the bellows 240I collapses, and the tip of spike-like element 240D punctures membrane 240G (stretching across the top of the chamber 240A) and then the spike-like element pierces the bottom 6 of primary container or can 8. Here, too, the elasticity and dimensions of the components can be configured so that the membrane of the chamber of the secondary container is not punctured until after the bottom of the primary container is punctured by the spike. Simultaneous rupturing of the membrane and the bottom of the primary container can also be used.

Liquid L2 from chamber 240A of the secondary container then comes into fluid communication with liquid L1 of primary container or can 8, thereby providing a new, desired liquid mixture of L1 and L2. When manual pressure is released, allowing the two containers to move away from one another, the bellows 240I re-expands (FIG. 36E), drawing some of liquid L1 back into chamber 240A, further mixing the contents of the secondary container and the primary container or can. Pushing the components together and then relaxing the compression allows the liquid of the secondary container to be forcibly injected into the liquid of the primary container. Basically, the two components are squeezed and relaxed like an accordion.

Yet, the device does not leak, owing to the sealing engagement of seal 240S to the bottom 6 of can 8 around the hole pierced through and into the bottom 6 of the primary container by spike-like element(s) 240D. Consumption of the mixed liquids proceeds as would be conventional through the openable pop top tab of the primary container 8.

Yet another or fifth embodiment is shown in FIGS. 22-27, one in which the secondary container 50 attaches to or near the top and side of the primary container or can 8 and punctures the sidewall 5 or hull of the primary container or can 8.

Secondary container 50 includes an internal chamber 50A which contains a secondary substance or liquid or powder L2 to be mixed with the primary liquid contents L1 of primary container or aluminum can 8. Chamber 50A may be integral with its housing 50F or it may be a separate but contained flexible pouch 50J. Secondary container 50 is preferably formed of hard plastic or thin sheet metal, similar to that of the primary container. In basic profile and configuration, it resembles a hollow, plastic-like sun-visor, yet filled with liquid L2 or containing and securing the pouch of liquid L2. It is formed at its top by a central band having backwardly extending and somewhat resilient can gripping arms 50R. The gripping arms and central band serve to secure the device to the top and outside wall of the cylindrical primary container 8, like the gripping and holding of a plastic, resilient sun visor to the top of one's forehead. The resiliency of the arms and their radius of curvature is such as to allow the secondary container to snap over and onto the top and side of the primary container 8. The resiliency of the arms facilitates this integration and holding. When in place, the secondary container extends around the upper rim of can 8 so that the rear surface of the central band largely is placed against and abuts the outside of the sidewall 5 of can 8. The secondary container is defined by a rear surface to the central band which sits on the outside wall of the primary container and a front or outer surface to the central band, separated from the rear or back surface and defining between them a chamber for the liquid or for the pouch holding the liquid.

Figure 23:
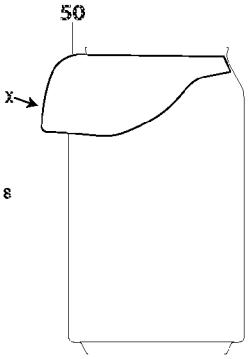
FIG. 23 is a perspective and elevational view of the fifth embodiment of the invention, similar to that shown in FIG. 22, showing the secondary container attached to the side of a conventional aluminum can of the type shown in FIG. 21.
Figure 24:
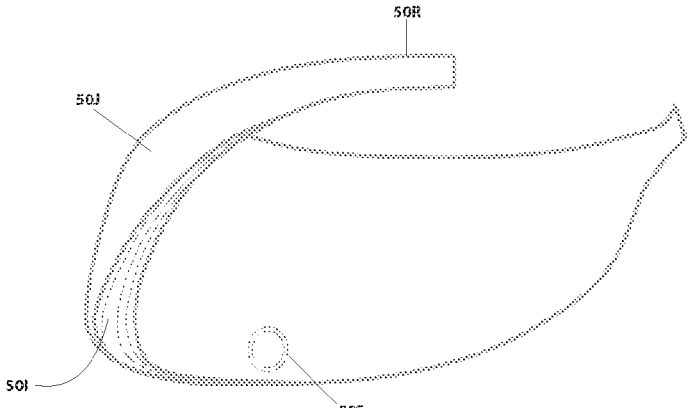
FIG. 24 is a perspective view of the embodiment of the secondary container, as shown in FIGS. 22 and 23.
Figure 25:
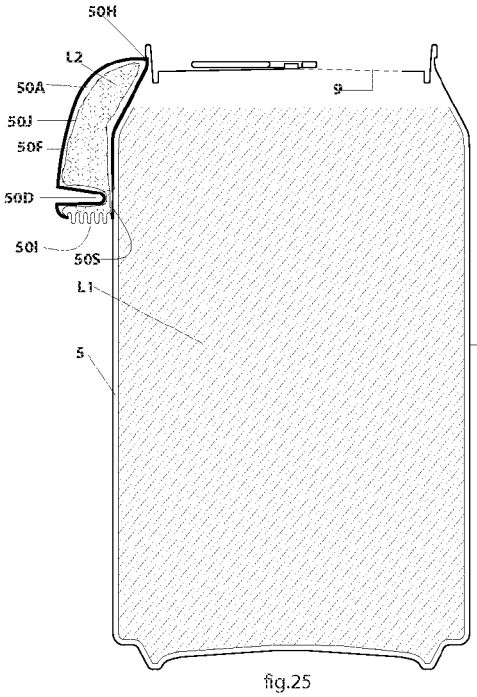
FIG. 25 is an enlarged, cross-sectional view of the embodiment of FIGS. 22 and 23, showing the attached secondary container with a secondary liquid, to a conventional aluminum can (the primary container) with pop top tab, as shown in FIG. 21 and containing a primary liquid, before the penetrator of the secondary container is actuated to pierce the frangible seal of the secondary container and then puncture the hull of the primary container or aluminum can.
Figure 26:
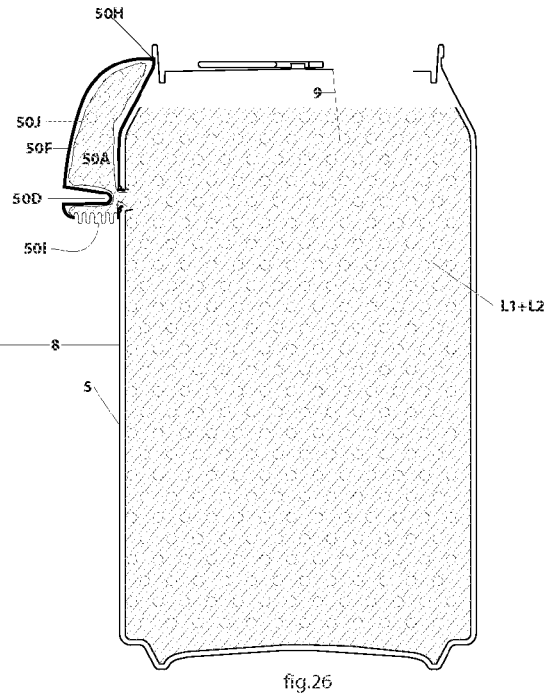
FIG. 26 is an enlarged cross-sectional view of the embodiment of the invention shown in FIGS. 22, 23, 24 and 25 and showing the secondary container attached to the side of the hull of a primary container, an aluminum, pop top tab can, with the liquids of the respective containers mixing, after the frangible seal of the secondary container is pierced by the mechanical penetrator and the penetrator has pierced the hull of the primary container and then retracted into the original orientation, and also showing the opening of the pop top tab for pouring of the mixed contents from the integrated containers.
Figure 27:
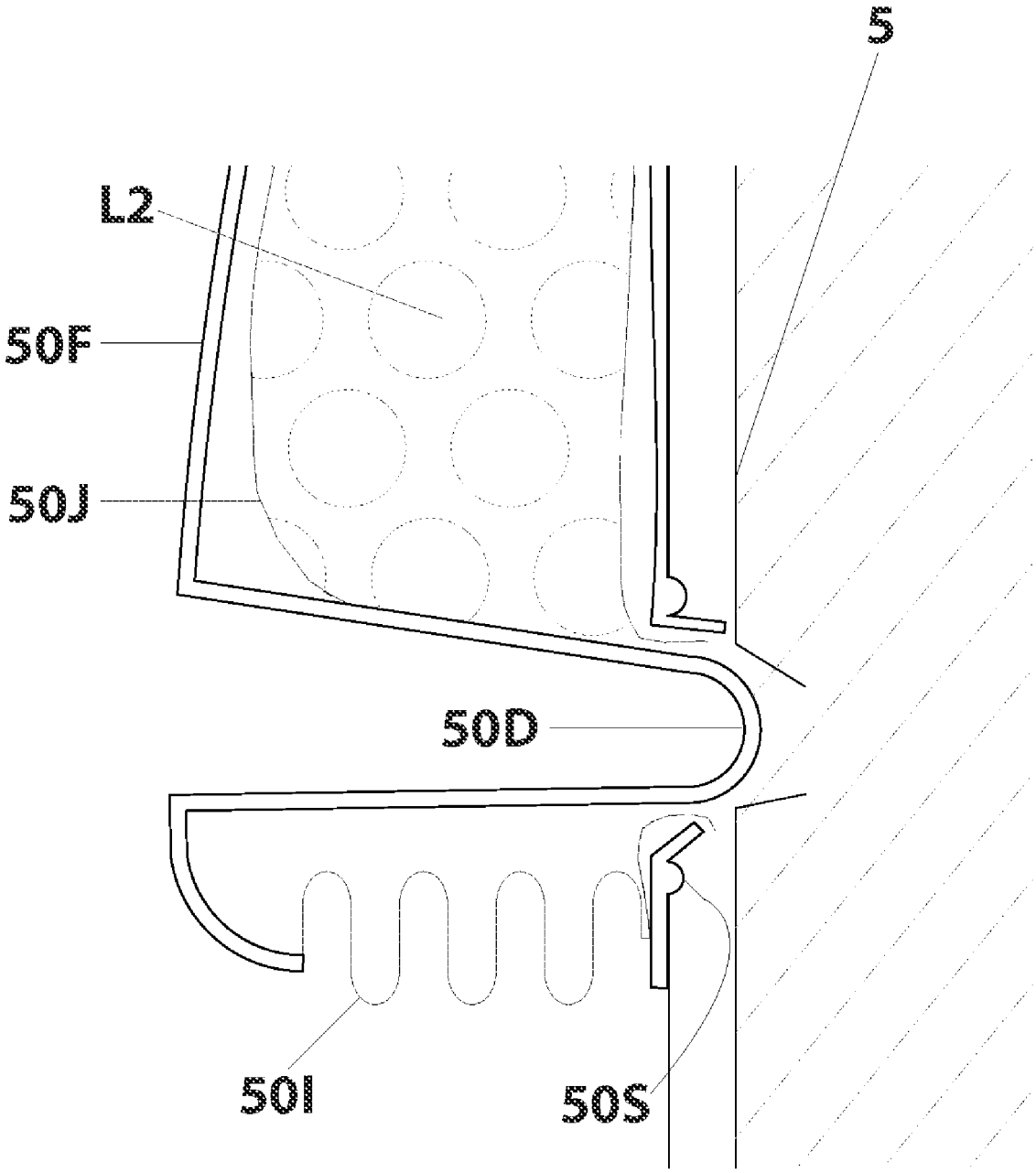
FIG. 27 is an enlarged partial or detail section of the embodiment of FIGS. 22 through 26, showing the puncturing of the hull or sidewall of the aluminum can, the primary container by the mechanical penetrator.
Figure 28:
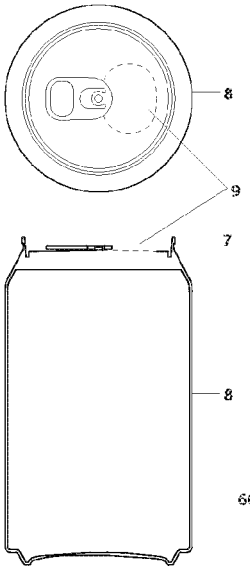
FIG. 28 is a side, cross-sectional and top view of a conventional aluminum can, the so-called primary container, with conventional shape, pop top tab, and base and top substantially as shown in FIGS. 1, 6, 11, 16, and 21 but repeated here for illustration of another embodiment of the invention, the secondary container as set forth in FIGS. 29 through 32.
Figure 29:
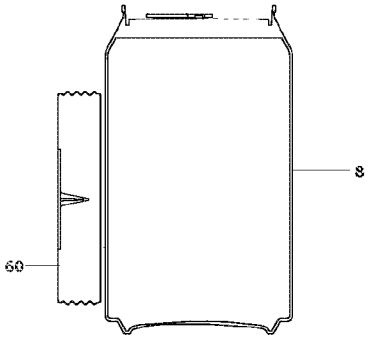
FIG. 29 is a cross sectional view of another embodiment of the invention, a secondary liquid container, attached to the side of a conventional aluminum can, the primary container, as shown in FIG. 28.
Figure 30:
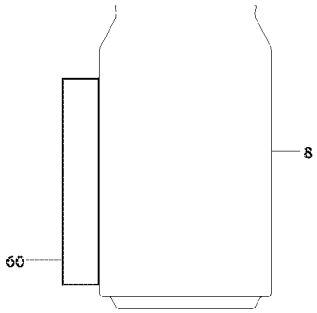
FIG. 30 is a perspective and elevational view of another embodiment of the invention, similar to that shown in FIG. 29, showing the secondary container attached to the side of a conventional aluminum can of the type shown in FIG. 28.
Figure 31:
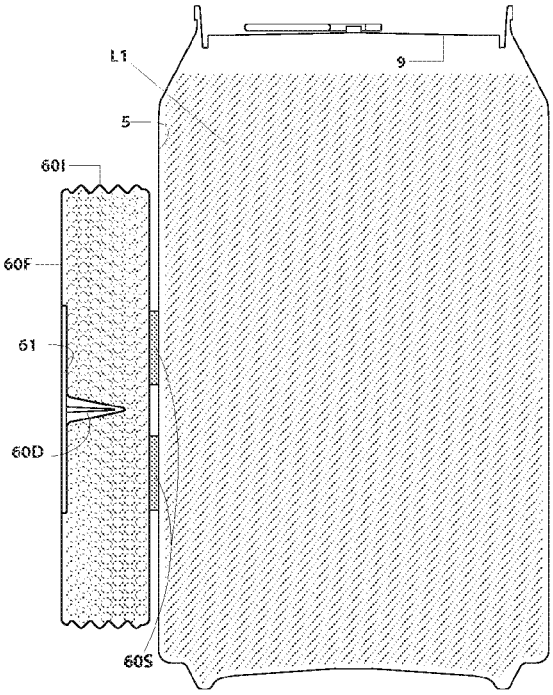
FIG. 31 is an enlarged, cross-sectional view of the embodiment of FIGS. 29 and 30, showing the attached secondary container with a secondary liquid, to the side wall of a conventional aluminum can (the primary container) with pop top tab, as shown in FIG. 28 and containing a primary liquid, before the penetrator of the secondary container is actuated to pierce the wall of the secondary container and then puncture the hull of the primary container or aluminum can.
Figure 32:
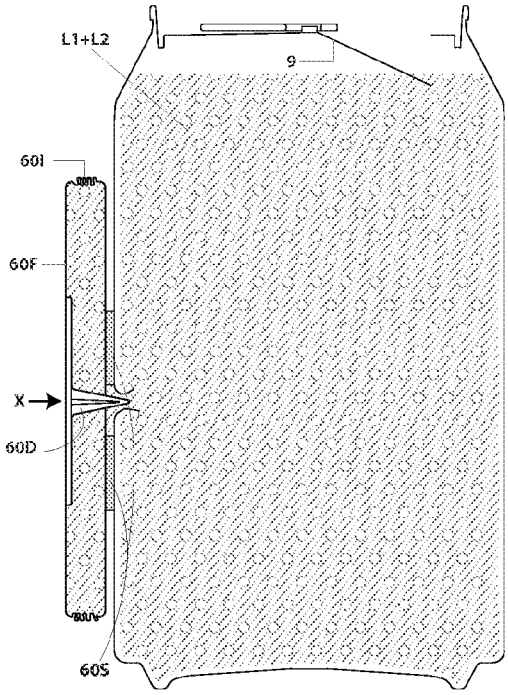
FIG. 32 is an enlarged cross-sectional view of the embodiment of the invention shown in FIGS. 29, 30, and 31 and showing the secondary container attached to the side of the hull of a primary container, an aluminum, pop top tab can, with the liquids of the respective containers mixing, after the wall of the secondary container is pierced by the mechanical penetrator and the penetrator has then pierced the hull of the primary container and showing the contraction of the bellows of the secondary container to facilitate the mixing of liquids and also showing the opening of the pop top tab for pouring of the mixed contents from the integrated containers.

Housing 50F should be sufficiently elastic or resilient to downwardly flex about and at hinge 50H (at the top of the secondary container) when pressure is applied in the direction of arrow X (see FIG. 23). The hinge extends along the top edge of the central band and is defined by the intersection of the rear surface and the front surface of the central band. Spike-like element or penetrator 50D is preferably formed integrally with housing 50F and projects inwardly or towards the side wall of the primary container 8. When assembled together, the spike-like element is opposed to the wall of the primary container 8. At the base of the secondary container, a bellows like crumple zone 50I is provided, extending between the outside of the primary container or can and to the outside edge of the chamber of the secondary container. The chamber, formed between the back wall of the central band and the front face of the visor-like secondary container holds the liquid L2 or holds a pouch which holds the liquid L2. A ring seal, sticky seal, or other fluid containing seal, 50S is disposed around the area of penetration of spike-like element 50D for providing a leak proof transfer of liquid L2 into the primary container, for mixing with liquid L1, when the side of the primary container is pierced by the spike like element. Preferably the fluid like seal 50S encircles the spike-like element, even if the spike-like element has a lateral dimension, i.e., it is not a mere pin point piercing element but, rather, can be a device for providing an oval opening, i.e., an opening with some horizontal or vertical length for a more rapid mixing of the liquids. Here, too, the seal can be provided with release paper to protect, until use, the adhesive sealing layer or ring provided by the secondary container. Housing 50F also includes a crumple zone 50I so that manual pressure applied in the direction of arrow X (see FIG. 23) will cause the hinged movement (about hinge 50-H) of spike-like element to come into contact and piece the wall or hull of the primary container 8. Then, further mechanical pressure in the direction of X will result in the crumpling of 50I and the rapid injection of the liquid L2 into the contents of the primary container L1. As the volume within the chamber compresses and the fluid is incompressible, the pouch (if provided) will rupture and the liquid will commence to flow from secondary container 50 into primary container 8.

In operation, this embodiment works as follows. The release paper or membrane protecting the adhesive layer atop ring seal 50S is removed, and secondary container 50 is snapped and placed around and on top of can 8 with flanges or rearwardly extending resilient arms 50R encircling the can just below its upper rim 7, similar to how one would attach a sun visor about one's forehead. Seal 50S forms a leak-free connection with wall 5 of primary container or can 8 while the resiliency of the arms mechanically secures the device to the primary container 8. Manual pressure applied in the direction of arrow X to the outer wall of housing 50F compresses crumple zone 50I about hinge point 50H and forces spike-like element or penetrator 50D through the side wall 50F first of the secondary container and then through the side wall 5 of primary container or can 8. The puncture of the side wall of the can 8 occurs within the boundary defined by the ring seal 50S, ensuring that the liquid contents L2 of secondary container 50 (within or not a pouch) and can 8 mix without leakage. In an alternate embodiment with a pouch for holding the liquid L2, the movement of the piercing element first causes the primary container to be pierced and, yet, further compression of the secondary container, about hinge 50H, compresses the chamber and, as a consequence of the incompressible fluid within a smaller chamber, the pouch of liquid L2 ruptures and passes through and into the liquid L1 of the primary container 8.

To consume the newly mixed liquids, L1 and L2, the pop top tab 9 is opened. Slight and gentle pressure can be applied to housing 50F to inject contents L2 of chamber 50A into can 8 creating an instant and uniform mixed drink.

A sixth embodiment and the currently preferred embodiment, also a side-mountable secondary container 60, appears in FIGS. 29 through 32. Secondary container 60 is similar to the embodiment shown as secondary container 50. Secondary container 60 is a single-chambered device having internal chamber 60A which contains substance, liquid and/or powder L2 to be mixed with the liquid contents L1 of the primary container or aluminum can 8. Secondary container 60 is preferably slightly curved in its rear profile/configuration to conform that back surface to the side wall of the primary container 8. It has some height and width dependent, of course, upon the volume of substance or liquid L2 to be contained by the secondary container. It is formed from a continuous piece of metal, rubber, or plastic (or other suitable material) housing 60F, which includes a crumple zone or set of bellows 60I, preferably at its top and bottom edges. Basically, it is shaped like a parallelepiped container with top and bottom walls of bellows. This secondary container 60 attaches to the side of a primary container or aluminum beer or soda can 8. Its inside radius of curvature or geometry matches that of the outside of the primary container for a matching fit and mechanical coupling of the two components. Extending towards the primary container, from the inner surface of the outside wall of the secondary container i.e., within the liquid-holding chamber of the secondary container, is a spike-like element or penetrator 60D. It is preferably attached to that wall by its base 61 and extends from an inner side of the outer wall of housing 60F. At the back wall of the secondary container is a ring seal 60S. It is provided in alignment with and substantially surrounding spike-like element 60D, i.e., at its location of wall penetration, again, for a leak-proof sealing cooperation of the secondary container and the primary container. An adhesive layer is preferably disposed atop adhesive ring seal 60S which is itself covered by release paper (not shown) or the like.

According to one aspect of the invention, the secondary container is secured to the primary container by use of a sticky seal material, i.e., a slightly compressive adhesive substance which ensures mechanical coupling by the stickiness of the material and, in addition, water tightness by the compressibility of the material. In the embodiment of the invention where the secondary container is connected to the side wall of the primary container, the sticky seal or mechanical and fluid-tight coupling may be important. Preferably it is in the shape of an "O." This O-seal or coupling will surround the tip of the penetrator when the secondary container is "activated" by pressing the activator mechanism to pierce the wall of the primary container, i.e., when the substance of the secondary container is desirably mixed into the liquid of the primary container. The use of the O-shaped sticky seal, particularly on the side-mounted embodiment of the present invention, also contains the propagation of any rupture in the hull of the primary container (preferably a conventional aluminum beer or soda can). The sticky seal composition or the O-shaped ring (of combined adhesive and fluid tight material) reinforces the primary container's side wall at the point of application and minimizes the spread of the rupture, i.e., the sticky seal contains the rupture of the side wall of the primary container within the boundary of the sticky seal such that it doesn't extend far beyond since the sticky seal will absorb some of the force of the penetration by the penetrator mechanism. Thus, the sticky seal, surrounding the site of the piercing by the penetrator mechanism into the primary container, will, by localizing the rupture and blocking or minimizing its spread beyond the perimeter of the sticky seal, substantially, ensure fluid tightness, i.e., the substantial leakproof transfer of substance from the secondary container to the primary container.

In operation, the release paper is removed from ring seal 60S, exposing the adhesive. Secondary container 60 is placed firmly against the outside of the side wall 5 of can 8 so that adhesive ring seal 60S forms a mechanical and a watertight connection to the can. Pressure is then applied in the direction of arrow X (see FIG. 32) to the housing 60F of the secondary container 60, thereby causing flexible bellows 60I (at the top and bottom of the chamber) to compress and thereby forcing spike 60D first through the opposed side wall of the housing 60F, through the center of the sealing ring 60S, and then through side wall 5 of the primary container or can 8. With the puncture of both walls, namely, the side wall of the secondary container and the primary container, the liquids can mix together. Once pull top tab 9 is opened, gentle pressure to the outer wall of cartridge 60 further compresses the secondary container and more vigorously injects the contents, liquid L2, of chamber 60A into the primary container for mixing with the contents L1 of can 8. The flexibility of the bellows walls and the secondary container allows the user to use the secondary container as a pump like mechanism to forcibly inject the secondary liquid into the primary liquid. The bellows not only contracts when liquid L2 is sought to be injected into the primary container but will expand to allow the mixed contents, L1 and L2, to be drawn into the chamber and then re-injected into the primary container. When desired, the pop top tab of the primary container can be opened and the mixed drink consumed.

Figure 37:
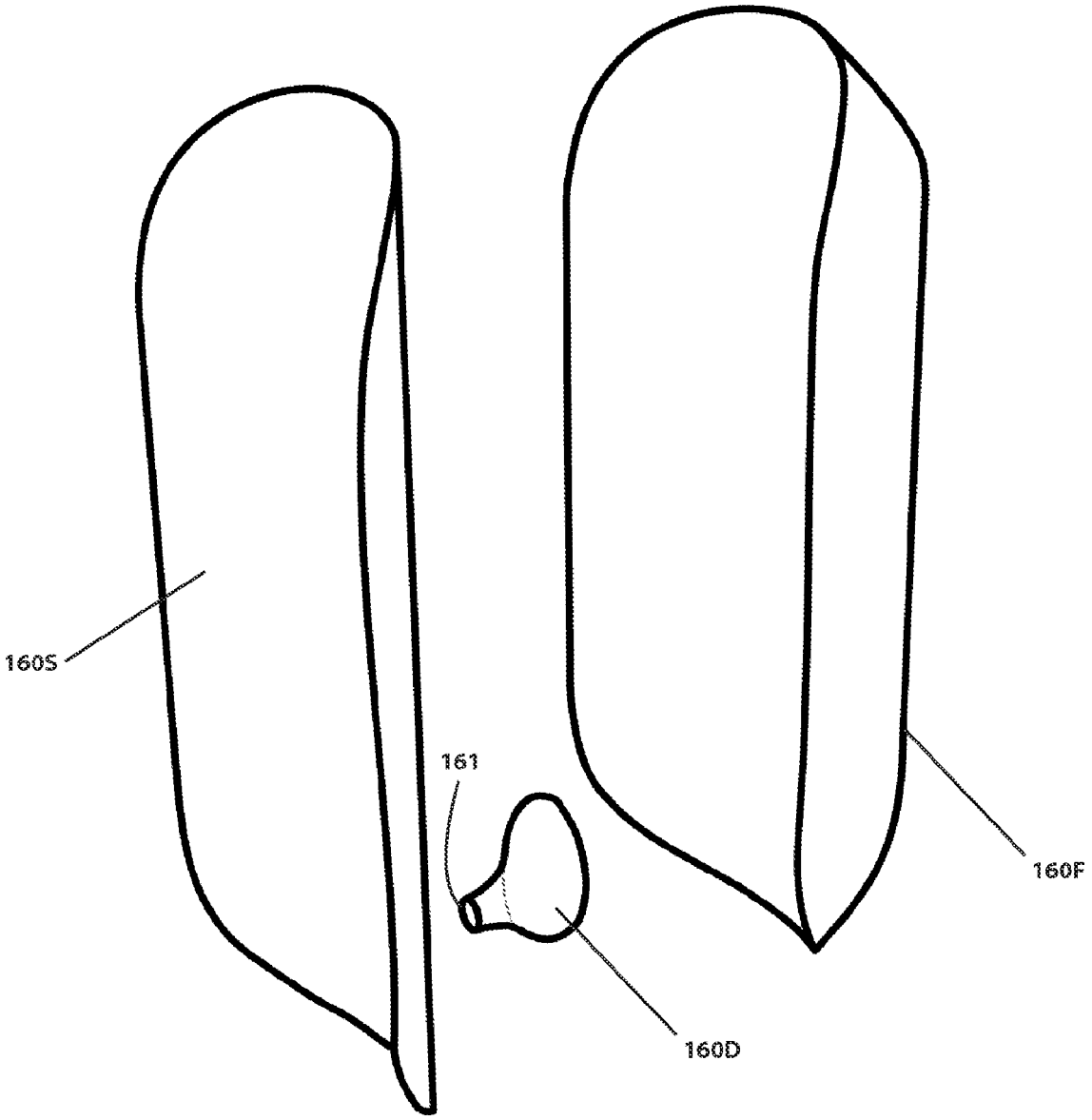
FIG. 37 is an exploded perspective view of a believed more commercially acceptable version of the embodiment of the secondary container as shown FIGS. 29-32.

FIG. 37 depicts an exploded perspective view of three of the main components of a device believed to be more commercially acceptable of the embodiment shown in FIGS. 29-32. Here, seal 160S is not merely a ring seal as seal 60S but rather is an elongated, curved and wide footprint of adhesive and fluid sealant material. It covers all or nearly all of the footprint of the secondary container when it is placed upon the side wall of the primary container or can 8. Preferably, housing or fluid chamber 160F is simply a concave volumetric shape and size, adequate to physically mate with the curvature of the outside of a standard beer or soda can. Housing 160F holds the liquid L2 for mixing with the liquid L1 of the primary container.

In this embodiment, it appears that the lateral extension of the secondary container is about 25% or 90 degrees of the exterior circumferential surface of the primary container 8. Its basic shape is shown in FIG. 37. The hollow chamber, filled with liquid L2, is interior sealed off by adhesive seal 160S. It is adapted to mate with the side wall of a primary container, an aluminum beer or soda can 8. Spike-like element 160D is preferably affixed to the inside wall of housing 160F, either directly or with some intermediate structure therebetween. Spike 160D is preferably hollow, terminating in an opening or fluid passageway 161, so that the contents L2 of the secondary container, held initially within housing 160F, and the contents L1 of the primary container, held within the can 8, can mix when the spike and its opening are pierced through the thin wall of the primary container. Housing 160F may be made with crumple zones or a bellows, or it may simply be made from a soft flexible and compressible material, such as thin plastic like polyethylene bags. When attached to a primary container, the contents of the secondary container, held within chamber 160F can pass through the opening 161 and into the primary container if the leading tip or spike-like element 160D pierces the hull of the primary container. Further compression of the chamber 160F and the secondary container toward the side wall of the primary container will cause any seal on the opening in the spike to rupture, thereby causing the liquid L2 of the secondary container to mix with the fluid/liquid L1 of the primary container 8. Here, too, as in many of the other embodiments, the spike like element may be provided with a set of holes or perforations to facilitate fluid mixing and flow.

The invention is not limited to the above description, and modifications are contemplated. For example, in some embodiments, the spike-like element or penetrator encounters the seal or membrane for the secondary container first before encountering the hull of the primary container, the soda or beer-can, and the membrane or seal for the liquid within the secondary container can first be punctured i.e., before the hull of the primary container. It is also contemplated that the pressure or force required to pierce the seal or membrane is greater than that required to penetrate the hull of the can, particularly in the embodiments where the spike-like element or penetrator is used to push open the already scored or perforated pop top tab 9 of can 8. Additionally, although only two embodiments show a spike-like element or penetrator having a hole, an opening, or perforations through which liquid L2 can pass and better mix with primary liquid L1, such holes, openings, or perforations may be formed in any of the spikes/penetrators shown. Also, any of the embodiments may be constructed with crumple zones or bellows. When pressure is applied to the exterior of a secondary container having such bellows, the bellows may be designed to also re-expand outward away from the pressure applied so as to maintain at least some of the overall volume of the secondary container. Then, pushing again on the bellows allows forcible re-injection of the liquid then contained within the secondary container into the primary container.

Regardless of which embodiment is employed, the invention is useful for a wide variety of purposes. It is particularly well-suited, as mentioned above, to providing newly made mixed drinks (e.g., rum and cola, vodka and orange juice, chocolate syrup and milk, etc.) where one secondary liquid such as a shot of alcohol, vodka, rum or chocolate syrup is added to a primary liquid such as orange juice, cola or milk. In such a use, the secondary container would preferably hold between 0.75 oz and 2.0 oz., more preferably between 1.0 and 1.5 oz. (a typical 'shot' of alcohol). Conventionally i.e., before the present invention, a third container was required to combine the two components; however by use of the inventive secondary container, with conventional and readily available primary containers, soda or beer-like cans of aluminum, no extra container is required and no new tooling is required for manufacture of the primary containers. Mixed drinks may be prepared in "field" conditions, such as while tailgating in a parking lot prior to a sporting event. The inventive secondary containers also give the user a predefined and certain amount of added mix of substance, likely liquid, to a well known quantity of liquid in the primary container for a precisely blended mixed drink. Also, the user may experience gratification in poking a hole in a sealed container by squeezing the containers together, similar to the same gratification experienced by crushing an empty container such as a beer can.

The inventive containers may also be employed for adding various components to children's beverages in a pre-measured and spill-free manner. For example, chocolate (or other flavored) syrup may be contained in a secondary container designed to be attached to a primary container of milk. Without the invention, a third container such as a glass may be needed, a particularly unappealing concept to harried parents in a car or those seeking to consume mixed beverages away from home. The present invention provides a manner of flavoring milk or other liquids in a precise and messless manner and also has the added benefit of limiting the amount of flavoring delivered to a given quantity. A precise and carefully measured mixed drink is thus provided. The secondary containers so employed may contain as little as a half a teaspoon of flavoring. Alternatively, the secondary containers may be used to add nutritional supplements into a beverage, either for children or adults.

Having described certain embodiments of the invention, it should be understood that the invention is not limited to the above description or the attached exemplary drawings. Rather, the scope of the invention is defined by the claims appearing hereinbelow and any equivalents thereof as would be appreciated by one of ordinary skill in the art.

What is claimed is:

1. A secondary container of a secondary substance for selective mixing with a primary liquid within a sealed primary container comprising an outer, thin-walled hull having its own opening, comprising:

a sealed first chamber for said secondary substance within a housing defined by the secondary container;

a frangible seal initially maintaining said secondary substance within said chamber;

attachment means for mechanical and leak-proof attachment of said housing to the hull of the primary container in an orientation that places said frangible seal proximate to the hull of the primary container; and a penetrator, a component of said housing, said penetrator adapted to be moved to penetrate through the hull of the primary container, the penetrating movement of said penetrator also causing said sealed chamber to become unsealed by piercing of said frangible seal;

wherein piercing and penetrating movement by said penetrator of said frangible seal and hull of the primary container, respectively, results in said penetrator being at least partially surrounded by said attachment means for a liquid seal between the primary container and said secondary container and also allows said secondary substance to mix and pour with the primary liquid, wherein said housing further comprises at least one, initially partially empty second chamber in communication with said first chamber holding said secondary substance, said second chamber of said housing providing a void volume to allow for the mixing of the primary liquid and said secondary substance when said frangible seal and hull are pierced and unsealed.

2. A secondary container as claimed in claim 1 wherein said penetrator is integral with said housing of said secondary container and reciprocates therein.

3. A secondary container as claimed in claim 1 wherein said penetrator is reciprocally secured to said housing of said secondary container and is selectively removable therefrom after mixing of said secondary substance with said primary liquid.

4. A secondary container as claimed in claim 1 wherein said attachment means comprises a sticky seal.

5. A secondary container according to claim 1, wherein the primary container is a conventional beverage can and said attachment means comprises a circular flange which mechanically and sealingly secures said secondary container to an upper rim of the conventional beverage can.

6. A secondary container according to claim 1, wherein the primary container is a conventional beverage can and said attachment means comprises a friction fit watertight sealing seal.

7. A secondary container according to claim 5 wherein said secondary container is securable to any of the top, bottom or a side wall of a conventional beverage can.

8. A secondary container according to claim 1, wherein said attachment means comprises at least a portion of said housing being resilient to facilitate mechanical attachment of said secondary container to said primary container.

9. A secondary container according to claim 1, wherein said penetrator is a spike-like element which mechanically pierces said frangible seal and also causes a provided opening of said primary container to open.

10. A secondary container according to claim 1 wherein said secondary container is provided with a separate, originally sealed yet openable pour spout/opening for allowing selective dispensing of the mixed contents of said secondary container and said primary container after said secondary substance and said primary liquid are mixed.

11. A secondary container according to claim 10 wherein said pour spout/opening opens up by the removal of said penetrator from said secondary container.

12. A secondary container as claimed in claim 1 wherein said primary container is a conventional can with a pop top tab and said penetrator of said secondary container is capable of being placed into visual mechanical alignment with the pop top tab of the primary container.

13. A secondary container as claimed in claim 12 wherein said visual mechanical alignment is provided by the bottom of said secondary container being of a shape which conforms to the top shape of the primary container.

14. Apparatus for housing and selectively adding a secondary substance to a primary liquid housed within an initially sealed primary container comprising a thin-walled, conventional beverage can-like hull, comprising:

a housing containing the secondary substance;

a frangible seal initially maintaining said secondary substance within said housing;

attachment means for mechanically attaching and fluidly sealing said housing to the hull of the primary container in an orientation that places said frangible seal proximal to the hull of the primary container; and an actuable penetrator disposed at least partially within said housing and proximal to said frangible seal, yet originally fluidly isolated from said primary liquid in said primary container, and movable from a first position within said housing to a second position breaching through both said frangible seal and through the hull of the primary container while maintaining said attachment means in a surrounding relationship with respect to said penetrator at the location of penetration of the hull of the primary container;

wherein moving said penetrator from said first position to said second position also causes said penetrator to puncture the hull of the primary container, thereby allowing said secondary substance to mix with the liquid of said primary container, and said penetrator being selectively removable from said housing for allowing mixed flow of said primary liquid and said secondary substance through said opening in said housing where said penetrator was located before removal, and wherein said housing has a separate mixing chamber which provides a void volume to allow for the mixing of said primary liquid and said secondary substance when said frangible seal is penetrated and said penetrator punctures the hull of said primary container.

15. Apparatus according to claim 14, wherein said secondary container is profiled and configured to mate with the primary container.

16. Apparatus according to claim 14, wherein said attachment means is a sticky sealant.

17. Apparatus according to claim 16 wherein said sticky sealant is self sealing to minimize the propagation of any rupture in said primary container.

18. Apparatus according to claim 14, wherein said attachment means comprises a circular flange and sealant substance which mechanically and sealingly secures said secondary container to the thin-walled conventional beverage can-like hull.

19. Apparatus according to claim 14, wherein said attachment means further comprises an adhesive sealant.

20. Apparatus according to claim 14, wherein said penetrator comprises a piercing tip.

21. Apparatus according to claim 20 wherein said piercing tip is located off-center to the primary container.

22. Apparatus according to claim 14, wherein said penetrator is selectively removable after it has pierced the primary container to allow for pouring of the mixed liquid.

23. Apparatus according to claim 14, wherein said secondary container is provided with an initially sealed pouring spout which can be selectively opened.

24. Apparatus according to claim 23, wherein said penetrator is removable from said housing to expose said pouring spout.

25. Apparatus according to claim 14, further comprising at least one opening formed through said penetrator through which fluid communication is established between said secondary substance in said secondary container and the primary liquid in said primary container when said penetrator pierces through said thin-walled conventional beverage can-like hull of the primary container.

26. A secondary container having a chamber for holding a secondary substance to be mixed with a primary liquid of a primary container, said primary container being of the thin-walled, conventional beverage can type with a pop top tab for opening the same, comprising:

a) said secondary container defining a housing, having a top surface and a bottom surface, for said secondary substance to temporarily contain the same within said secondary container, the bottom surface of said housing of said secondary container being adapted to sealingly fit onto the top of said primary container;

b) said housing of said secondary container having a frangible membrane confining said secondary substance within said housing and a penetrator for selectively piercing said membrane when said penetrator is actuated to pierce through said membrane to release said secondary substance from said housing and through said membrane;

c) said housing having a fluid sealing means for maintaining said secondary substance, when released from said housing and through said membrane, so as to mix with said primary liquid in either said secondary container, said primary container or as fluid is dispensed through the pop top tab of said primary container;

d) said penetrator, when actuated, also causing the pop top tab of said thin-walled, conventional beverage can to open; and e) said penetrator, after piercing said membrane and opening said pop top tab, providing an opening through which said primary liquid and said secondary substance, now at least partially mixed, pass for consumption, wherein said housing is also provided with a separate chamber, defined between said membrane and said bottom surface, and having initially no second substance contained therein but serving as a void volume for mixing said primary liquid and said secondary substance upon rupture of both said frangible membrane and said pop top tab of said primary container.

27. A secondary container as claimed in claim 26, wherein said fluid sealing means comprises a sticky and fluid sealing mechanism located around the outside periphery of said housing.

28. A secondary container as claimed in claim 26, wherein said secondary container is attached to said primary container by a circular flange and sealant mechanism cooperating between the bottom surface of said secondary container and the top of said primary container.

29. A secondary container as claimed in claim 26, wherein said penetrator comprises a piercing tip.

30. A secondary container as claimed in claim 26, wherein said penetrator is provided with an alignment mechanism to facilitate alignment of said penetrator and said pop top tab of said primary container.

31. A secondary container as claimed in claim 26, wherein said penetrator is removable for exposing an opening in said housing of said secondary container for allowing said primary liquid and said secondary substance to be poured therethrough.

32. A secondary container as claimed in claim 26, wherein said penetrator provides a fluid path through which said primary liquid and said secondary substance will pass upon tilting of said primary container.

33. A secondary container as claimed in claim 26, wherein said penetrator, when actuated, passes through said membrane, said bottom surface and said pop top tab of said primary container to open up a fluid path between said primary container and said secondary container.

* * * * *